US008201991B2

(12) United States Patent
Kouzuma

(10) Patent No.: US 8,201,991 B2
(45) Date of Patent: Jun. 19, 2012

(54) FREQUENCY CORRECTOR AND CLOCKING APPARATUS USING THE SAME

(75) Inventor: Shinichi Kouzuma, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 833 days.

(21) Appl. No.: 12/350,979

(22) Filed: Jan. 9, 2009

(65) Prior Publication Data

US 2009/0180358 A1 Jul. 16, 2009

(30) Foreign Application Priority Data

Jan. 10, 2008 (JP) ..... 2008-003063

(51) Int. Cl.
*G04B 18/00* (2006.01)

(52) U.S. Cl. ..... 368/201; 368/156

(58) Field of Classification Search ..... 368/200–202, 368/155–157

See application file for complete search history.

(56) References Cited

U.S. PATENT DOCUMENTS 4,282,594 A * 8/1981 Ichikawa ..... 368/82
4,407,589 A * 10/1983 Davidson et al. ..... 368/201
4,461,582 A * 7/1984 Walther ..... 368/201
4,707,145 A * 11/1987 Ishida ..... 368/201
4,903,251 A * 2/1990 Chapman ..... 368/156
5,327,404 A * 7/1994 Nolan ..... 368/201
5,481,507 A 1/1996 Suzuki et al.
6,304,517 B1 * 10/2001 Ledfelt et al. ..... 368/10
6,545,950 B1 * 4/2003 Walukas et al. ..... 368/47
7,118,269 B2 * 10/2006 Bening ..... 368/200
2003/0174587 A1 * 9/2003 Bening ..... 368/200

* cited by examiner

*Primary Examiner* — Sean Kayes
(74) *Attorney, Agent, or Firm* — Volentine & Whitt, PLLC

(57) ABSTRACT

In a frequency corrector, a counter divides a clock signal CK to be input into a fraction of a natural number larger than one to generate a signal having a clock frequency. The counter corrects the number of clock pulses of the signal having the clock frequency in response to a correction signal to output a first frequency-divided signal. A frequency divider circuit divides the first divided signal to output a unit time signal having another frequency and another frequency-divided signal Db composed of plural frequencies. A correction timing generator decodes the both divided signals to detect a correction timing for the first divided signal, and generates plural correction timing signals different in timing from each other. A correction signal generator generates the correction signal in response to the correction timing signals and correction values to provide the correction signal to the counter.

8 Claims, 18 Drawing Sheets

FIG. 9

| CORRECTION TIMING SIGNAL | FREQUENCY OF OCCURRENCE |
|---|---|
| TMG[0] | GENERATED ONCE PER 32 SECONDS |
| TMG[1] | GENERATED ONCE PER 16 SECONDS |
| TMG[2] | GENERATED ONCE PER 8 SECONDS |
| TMG[3] | GENERATED ONCE PER 4 SECONDS |
| TMG[4] | GENERATED ONCE PER 2 SECONDS |
| TMG[5] | GENERATED ONCE PER 1 SECOND |
| TMG[6] | GENERATED ONCE PER 0.5 SECOND |

FIG. 10

| CORRECTION VALUES [7:0] | | | | | | | | HEXADECIMAL | CORECTION FACTOR ppm |
|---|---|---|---|---|---|---|---|---|---|
| +/− | bit 6 | bit 5 | bit 4 | bit 3 | bit 2 | bit 1 | bit 0 | | |
| 0 | 1 | 1 | 1 | 1 | 1 | 1 | 1 | 7FH | +121.1 |
| 0 | 1 | 1 | 1 | 1 | 1 | 1 | 0 | 7FH | +120.2 |
| : | : | : | : | : | : | : | : | : | : |
| 0 | 0 | 0 | 0 | 0 | 0 | 1 | 1 | 03H | +2.86 |
| 0 | 0 | 0 | 0 | 0 | 0 | 1 | 0 | 02H | +1.91 |
| 0 | 0 | 0 | 0 | 0 | 0 | 0 | 1 | 01H | +0.95 |
| 0 | 0 | 0 | 0 | 0 | 0 | 0 | 0 | 00H | ±0 |
| 1 | 1 | 1 | 1 | 1 | 1 | 1 | 1 | FFH | −0.95 |
| 1 | 1 | 1 | 1 | 1 | 1 | 1 | 0 | FEH | −1.91 |
| : | : | : | : | : | : | : | : | : | : |
| 1 | 0 | 0 | 0 | 0 | 0 | 0 | 1 | 81H | −121.1 |
| 1 | 0 | 0 | 0 | 0 | 0 | 0 | 0 | 80H | −122.1 |

PRIOR ART

FREQUENCY CORRECTOR AND CLOCKING APPARATUS USING THE SAME

BACKGROUND OF THE INVENTION

1. Field of the Invention

The present invention relates to a frequency corrector which is mounted in a large-scale integration (LSI) circuit having a clock function, and more particularly to a frequency corrector for correcting a clock signal having a frequency of, e.g. 32.768 kHz, or the like output from a crystal-oscillator or the like, and to a clocking apparatus using the same.

2. Description of the Background Art

Conventionally, a technology relating to a clocking apparatus having a frequency corrector has been disclosed by U.S. Pat. No. 5,481,507 to Suzuki et al. The electronic clocking apparatus, device and method for determining a correction value disclosed by Suzuki et al., corrects a deviation in oscillating frequency generated by a clock oscillator, thereby removing trimming capacitor for adjusting oscillating frequency.

As seen from Suzuki et al., as a frequency corrector that corrects a clock signal having a frequency of 32.768 kHz output from a crystal-oscillator in the order of ppm (=1/1,000,000), the type of correcting a clock signal by means of a trimming capacitor mounted outside an LSI device has conventionally been predominant. However, recently, a nonvolatile type of memory or the like is mounted in an LSI device in many cases, so that a solution is growing popular in which a frequency corrector is mounted in a counter in an LSI device to correct a frequency of 1 or 2 Hz signal, corresponding to a period of 1 or 0.5 second, respectively, used in a clocking apparatus.

As a frequency corrector has been known which corrects a frequency by means of a counter such as R2051 which is a real-time clock (RTC) manufactured by Ricoh Company, Ltd., www.ricoh.com/LSI/product_rtc/2wire/r2051k/index.html. The frequency corrector is, as described in Suzuki et al., as well, composed of a correction value memory that stores correction values, and a variable frequency divider circuit which is capable of changing a frequency dividing ratio on the basis of the correction values and divides a clock signal having a frequency of 32.768 kHz to output a 1 or 2 Hz signal. Thus, the frequency corrector is configured to change the number of clock pulses of the variable frequency divider circuit on the basis of the correction values stored in the correction value memory so as to adjust a progress or delay of the clock, thereby correcting it to an accuracy of 1.5 ppm or 0.5 ppm, corresponding to the interval of once per 20 or 60 seconds, respectively.

However, the conventional frequency corrector suffers from the following problems. First, the variable frequency divider circuit in the conventional clocking apparatus, as exemplified as shown in FIG. 15, has a second counter adapted to count a 1-Hz signal, corresponding to a period of one second, output from the variable frequency divider circuit, and count up from "00" to "59" seconds, repeating the counting up from 00 to 59 seconds. Then, a frequency correction once per 60 seconds is performed during the second counter indicating 59 seconds to reset the variable frequency divider circuit. Not only the signals at the respective frequencies of 4.096 kHz to 1.024 kHz but also the signals at other frequencies are reset once per 60 seconds.

In a method for correcting frequencies at an interval of 20 or 60 seconds as done by the conventional frequency corrector, in a case in which a correction value is larger, for example, the clock time is made progress by +100 ppm with an accuracy of 0.5 ppm, the final one of the 60 seconds, i.e. the time that the second counter indicates 59 seconds, is shortened by a period corresponding to 200 clock pulses (about 6.1 ms) of a clock signal having a frequency of 32.768 kH. In this case, a signal at 1.024 kHz, for example, falling in the range of 32.768 kHz to 1 Hz (1 second) provided by the variable frequency divider circuit has a cycle of 1,017.75 pulses. As a result, the frequency is not corrected between the first cycle and the 1,017th cycle of the signal at 1.024 kHz, which leads to a correction timing once per 60 seconds causing the signal at 1.024 kHz having its cycle shorter, which is a 0.75 cycle. Therefore, in a case in which the signal at 1.024 kHz is used as a drive clock signal for a timer for stopwatch serving as a peripheral circuit of an LSI for example, it is impossible to perform accurate clocking by that stopwatch.

Secondly, the frequency corrector as disclosed by Suzuki et al., has a circuit generating correction values which is complicated. Moreover, because the crystal oscillating frequency of 32.768 kHz is divided down to 1 Hz by the variable frequency divider circuit, the variable frequency divider circuit is made complicated in circuit configuration. Therefore, the circuit scale of the entire frequency corrector is larger, and the power consumption is increased accordingly. Thus, when such a frequency corrector is incorporated into portable equipment or the like, the power consumption of its battery is increased so as to quickly die, which puts a limit on its use or the like.

SUMMARY OF THE INVENTION

It is an object of the present invention to provide a frequency corrector and a clocking apparatus using the same which are improved in reduction of the circuit configuration and power consumption thereof.

A frequency corrector according to the present invention includes a counter operative in response to a clock signal input at a first clock frequency for counting the number of clock pulses of the clock signal to divide the clock signal into a fraction of a natural number larger than unity to generate a signal at a second clock frequency, and for correcting the number of clock pulses of the signal at the second clock frequency in response to a correction signal to output a first frequency-divided signal, a frequency divider circuit that divides the first frequency-divided signal to output a unit time signal at a predetermined clock frequency and a second frequency-divided signal including a plurality of clock frequencies, a correction timing generator that decodes the first frequency-divided signal and the second frequency-divided signal to detect a correction timing for the first frequency-divided signal, and generates a plurality of correction timing signals different in timing from each other to output the plurality of correction timing signal, and a correction signal generator that generates the correction signal in response to the correction timing signals and correction values to provided the correction signal to the counter.

A clocking apparatus according to the present invention includes the frequency corrector stated above, a clocking counter that generates clock time data in response to the unit time signal output from the frequency divider circuit in the frequency corrector to output the clock time data, and an operational circuit operative at a predetermined time interval for finding an error between reference clock time data and the clock time data, and for calculating the correction values on the basis of the error and the predetermined time interval, to provide the correction values to the correction signal generator in the frequency corrector.

The frequency corrector of the present invention is thus configured such that a clock signal having its first clock frequency is divided by a counter to generate a signal at a second clock frequency, which is corrected in response to a correction signal to generate a first frequency-divided signal, which is in turn divided by the frequency divider circuit to output a unit time signal. It is therefore possible to obtain a more accurate unit time signal at every time interval shorter than that of the conventional art. Additionally, because the circuit configuration is simpler, the circuit scale can be reduced, which makes it possible to reduce power consumption.

The clocking apparatus of the present invention is thus configured so as to correct the first frequency-divided signal by the frequency corrector. Thus, the frequencies of all the signals output from the frequency divider circuit dividing the first frequency-divided signal are corrected. For example, in a case in which a signal output from the frequency divider circuit is used as a clock signal for actuating a timer for stopwatch, it is possible to perform more accurate clocking by a stopwatch or the like.

BRIEF DESCRIPTION OF THE DRAWINGS

The objects and features of the present invention will become more apparent from consideration of the following detailed description taken in conjunction with the accompanying drawings in which:

FIG. 9 shows the frequencies of occurrence of the correction timing signals output from the correction timing generator shown in FIG. 4;

FIG. 10 shows the relationship between the correction values and the frequency correction factors;

DESCRIPTION OF THE PREFERRED EMBODIMENTS

Embodiments according to the present invention will be described with reference to the accompanying drawings. Generally, a frequency corrector in accordance with the illustrative embodiments has a counter, a frequency divider circuit, a correction timing generator, and a correction signal generator, which will now specifically be described in detail.

In the frequency corrector, the counter is adapted to receive a clock signal having a first clock frequency and count the number of clock pulses of the clock signal to frequency-divide the clock signal into a fraction, or factor, of a natural number i, which is equal to or more than two, to generate a signal having a second clock frequency, and further to be responsive to a correction signal to correct the number of clock pulses of the signal of the second clock frequency to output a first frequency-divided signal.

The frequency divider circuit is adapted to frequency-divide the first frequency-divided signal to output a unit time signal having a predetermined clock frequency and a second frequency-divided signal composed of a plurality of clock frequencies. The correction timing generator is adapted to decode the first and second frequency-divided signals to detect a correction timing for the first frequency-divided signal, and generate a plurality of correction timing signals different in timing from each other to output the latter. The correction signal generator is adapted for being responsive to the correction timing signals and a correction value to generate the correction signal to provide the counter with the correction signal.

More specifically, the counter may have a first divider that is adapted to count the number of clock pulses of the clock signal and respectively frequency-divide the clock signal to output a plurality of first frequency-divided results, a selector that is adapted to be responsive to the correction signal to select the plurality of first frequency-divided results to output a selected result, and a second divider that is adapted to count the number of clock pulses of the clock signal and frequency-divide the selected result to output the first frequency-divided signal.

Figure 1A:
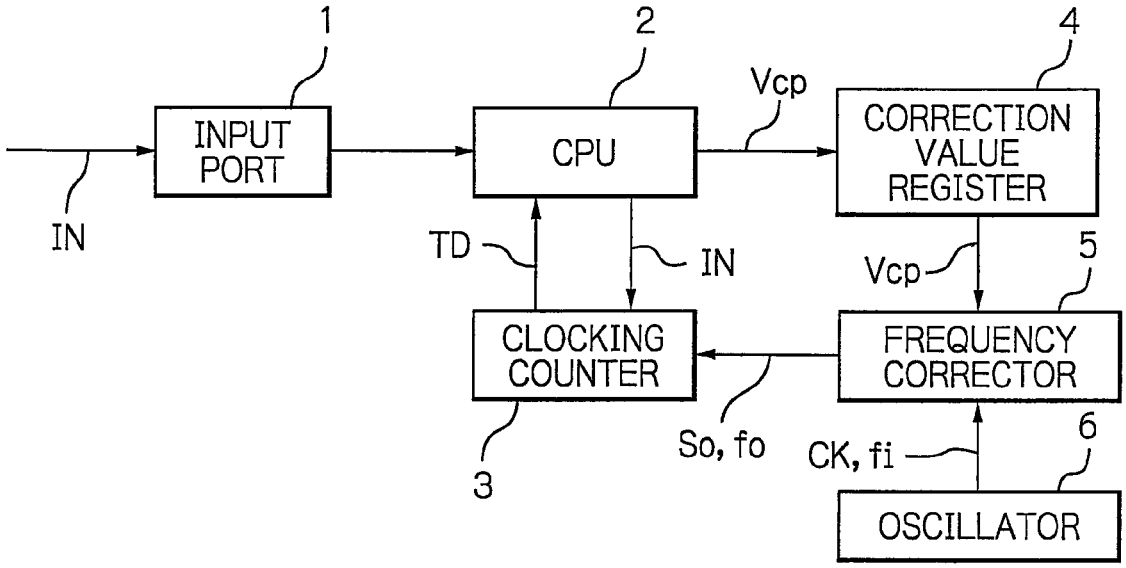
FIGS. 1A and 1B are a schematic block diagram showing a clocking apparatus having a frequency corrector according to a first illustrative embodiment of the present invention.
Figure 1B:
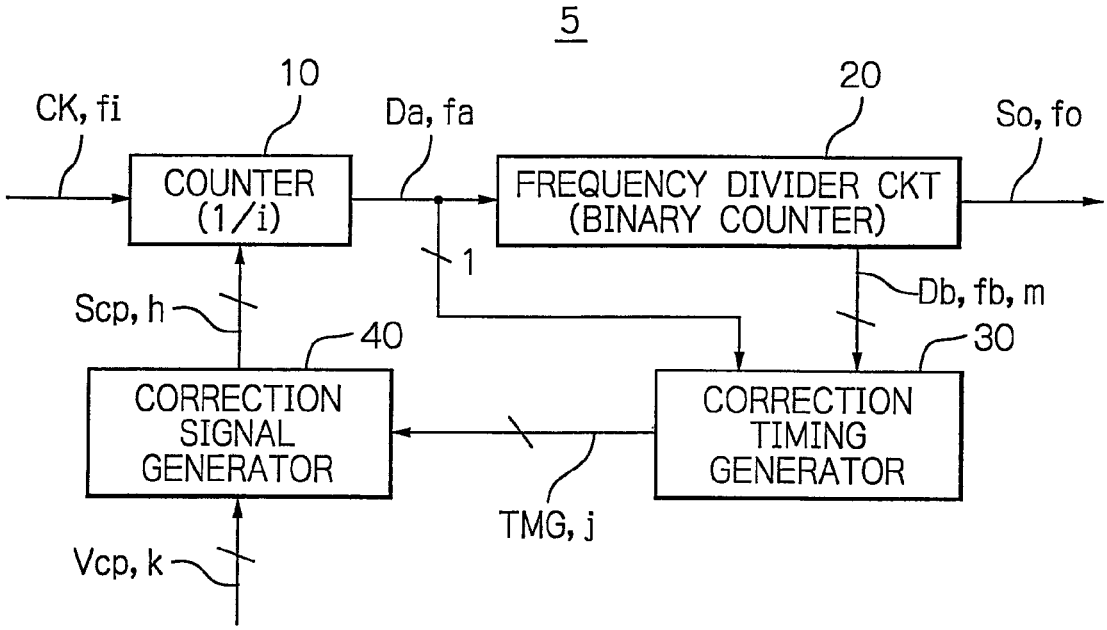

With reference to FIGS. 1A and 1B which are schematic block diagrams, a clocking apparatus having a frequency corrector 5 according to a first illustrative embodiment of the present invention will be described. FIG. 1A is a schematic block diagram of the clocking apparatus, and FIG. 1B is a schematic block diagram of the frequency corrector 5 shown in FIG. 1A.

The clocking apparatus shown in FIG. 1A has an input port 1 to which reference clock time data IN generated at regular intervals are input. The reference clock time data IN may be, for example, a time tone broadcast at twelve midnight on radio, television or the like. To the input port 1, connected is operational means, such as a central processing unit (CPU), to which a clocking counter 3 and a correction value register 4 composed of a nonvolatile memory and the like are connected. To the clocking counter 3 and the correction value register 4, a frequency corrector 5 is connected, to which, an oscillator 6 is connected.

The CPU 2 has a function of performing operation at a predetermined time interval to find an error x between the input reference clock time data IN and the counted time data TD, and calculate a correction value Vcp on the basis of the error x the predetermined time interval to store the value in the correction value register 4. For example, to the CPU 2, a display unit or the like, not shown, for displaying time or the like thereon is connected, and the CPU 2 has a function of setting reference clock time data IN to the clocking counter 3. The CPU 2 further has a function of using an error x between time data TD provided from the clocking counter 3 immediately before the reference clock time data IN is set and the reference clock time data IN (=time data TD−reference clock time data IN) and the predetermined time interval (e.g. 24 hours), and using the frequency correction factor to find a frequency correction factor ($=10^6\times$error x in a 24-hour period) to calculate a correction value Vcp to store the latter in the correction value register 4. Signals or data are designated with reference numerals of connections on which they are conveyed.

The clocking counter 3 is adapted for frequency-divide a unit time signal So (for example, 1 second) having a predetermined clock frequency fo (for example, 1 Hz) to output time data TD including, e.g. hours, minutes, or seconds, to the CPU 2. The frequency corrector 5 is adapted to receive a clock signal CK of a first clock frequency fi (for example, about 32.768 kHz) output from the oscillator 6, which is composed of a crystal-oscillator or the like, and frequency-divide the clock frequency fi of the clock signal CK to generate a unit time signal So at a clock frequency fo. The frequency corrector 5 is further adapted for correcting the clock frequency fo on the basis of the correction value Vcp stored in the correction value register 4 to provide the corrected frequency to the clocking counter 3.

The frequency corrector 5 shown in FIG. 1B has a counter 10, which is adapted to receive a clock signal CK of a clock frequency fi output from the oscillator 6 to count the number of clock pulses of clock signals CK to be input and frequency-divide the clock signal CK into the factor of the natural number i stated above, e.g. four, to generate a signal at a second clock frequency fa (for example about 8.192 kHz). The counter is further adapted to use an h-bit correction signal Scp, which may be, for example, 2-bit correction signal Scp [1:0], where [1:0] denotes 2 bits, to correct the number of clock pulses of the signal having the clock frequency fa to output a first frequency-divided signal Da. The correction may include, for example, four types of corrections, such as +1 clock pulse ahead, ±0 clock pulse on time, −1 clock pulse behind, and −2 clock pulse behind. The counter 10 has its output port connected to a frequency divider circuit 20 and a correction timing generator 30.

The frequency divider circuit 20 is adapted to frequency-divide the first frequency-divided signal Da to output the unit time signal So at the predetermined clock frequency fo (for example, 1 Hz) and a second frequency-divided signal Db composed of a plurality (m) (for example, m=18) of clock frequencies fb (for example 4.1096 kHz to 1/32 Hz, corresponding to 32 seconds). The frequency divider circuit 20 may be composed of a binary counter or the like, and has its output port connected to the correction timing generator 30.

The correction timing generator 30 is adapted to decode the first frequency-divided signal Da and the second frequency-divided signal Db to detect a correction timing for the frequency-divided signal Da to generate a plurality of correction timing signals TMG having j bits, which may be, for example, seven-bit correction timing signals TMG[6:0], different in timing from each other to output those signals. The correction timing generator 30 is composed of a decoder or the like, and has its output port connected to a correction signal generator 40 serving as a control circuit.

The correction signal generator 40 is adapted to be responsive to the correction timing signals TMG[6:0] and the k-bit (for example 8-bit) correction values Vcp[7:0] to generate a 2-bit correction signal Scp[1:0] to provide the latter to the counter 10.

Figure 2:
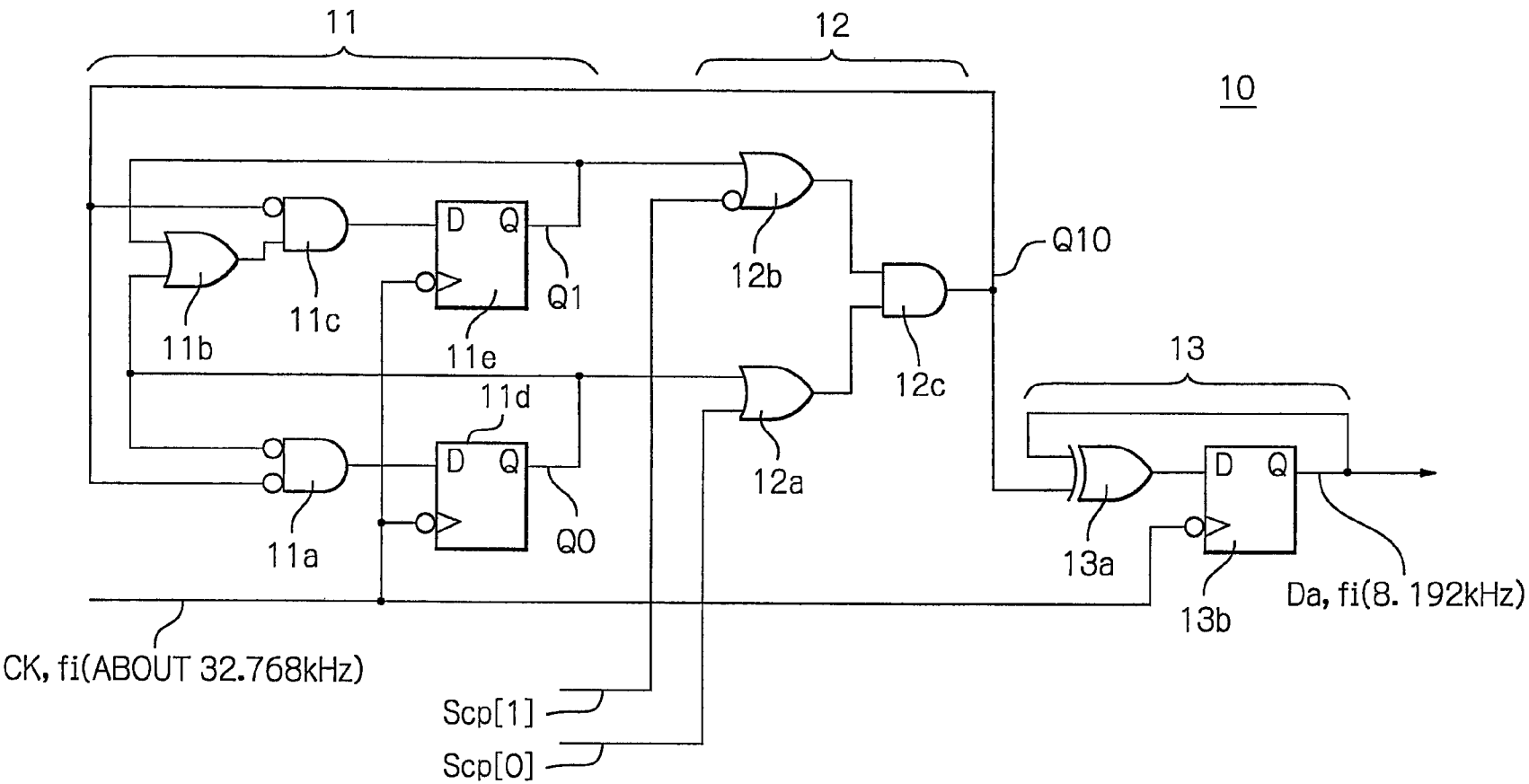
FIG. 2 is a schematic circuit diagram showing a configuration example of the counter shown in FIG. 1B.

FIG. 2 is a schematic circuit diagram showing a configuration example of the counter 10 shown in FIG. 1B. The counter 10 is composed of a first frequency divider 11 that is adapted to count the number of clock pulses of clock signals CK, and respectively frequency-divides the clock signal CK to output a plurality (for example, two) of first frequency-divided results Q1 and Q2. The counter 10 includes a selector 12 which is connected to the output side of the frequency divider 11 and is adapted to select the first frequency-divided results Q1 and Q2 in response to the correction signals Scp[0] and Scp[1] to output a selected result Q10. The counter 10 further includes a second divider 13 which is connected to the output side of the selector 12 and is adapted to count the number of clock pulses of the clock signal CK and frequency-divide the selected result Q10 to output the first frequency-divided signal Da at a frequency fi, which may be, for example 8.192 kHz.

The first frequency frequency-divider 11 has logic circuits comprising, for example, a two-input logical AND gate 11*a* that derives a logic of inverted results of the frequency-divided result Q0 and the selected result Q10, a two-input logical OR gate 11*b* that derives a logic of the frequency-divided result Q0 and an inverted result of the selected result Q10, and a two-input AND gate 11*c* that derives a logic of the logical result of the OR gate 11*b* and an inverted result of the selected result Q10. The AND gate 11*a* has its output port connected to a first flip-flop circuit, for example, a delayed type of flip-flop circuit (DFF), 11*d*, and the AND gate 11*c* has its output port connected to a second flip-flop circuit 11*e*, which may also be, for example a D type of flip-flop.

The first flip-flop 11*d* is adapted to receive the logical result from the AND gate 11*a* in synchronous with the negative-going edge of the clock signals CK to output the frequency-divided result Q0 to count the number of clock pulses of the clock signals CK, and frequency-divide the clock signals CK into a fraction of two, i.e. halved, to output the frequency-divided result Q0. The second flip-flop lie is adapted to receive a logical result from the AND gate 11*c* in synchronous with the negative-going edge of the clock signals CK to output the frequency-divided result Q1 to count the number of clock pulses of the clock signals CK, and frequency-divide the clock signals CK into a fraction of two to output the frequency-divided result Q1.

The selector 12 is adapted to select the two first frequency-divided results Q1 and Q2 in response to the two-bit correction signals Scp[1] and Scp[0] to output the selected result Q10, and may be constituted by logic circuits, such as two two-input OR gates 12*a* and 12*b* and a two-input AND gate 12*c*. The OR gate 12*a* is adapted to find a logical OR of the correction signal Scp[0] and the frequency-divided result Q0. The OR gate 12*b* is adapted to find a logical OR of an inverted result of the correction signal Scp[1] and the frequency-divided result Q1. The OR gates 12*a* and 12*b* have the output ports thereof connected to the AND gate 12*c*.

The second frequency divider 15 is composed of logic circuits, such as a two-input exclusive OR gate (EXOR) 13*a* that derives a logic of the first frequency-divided signal Da and the frequency-divided result Q10, and a third flip-flop circuit 13*b*, which may be D type of flip-flop, connected to the output side of the logic circuit 13*a*. The flip-flop 13*b* is adapted to receive a logical result from the EXOR gate 11*a* in synchronous with negative-going edges of the clock signals CK to output the first frequency-divided signal Da, and to frequency-divide the selected result Q10 in response to the clock signals CK into a fraction of two, i.e. halved, to output the frequency-divided signal Da.

Figure 3:
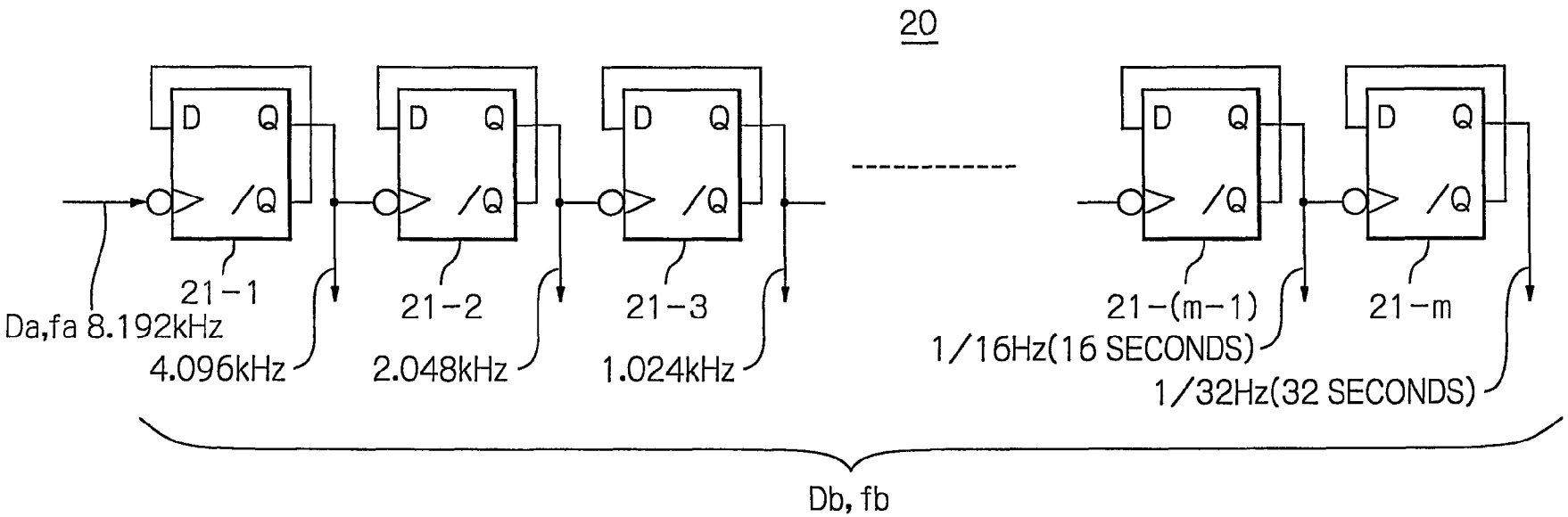
FIG. 3 is a schematic circuit diagram showing a configuration example of the frequency divider circuit shown in FIG. 1B.

FIG. 3 is a schematic circuit diagram showing a configuration example of the frequency divider circuit 20 shown in FIG. 1B. The frequency divider circuit 20 is composed of an asynchronous binary counter which has a plurality (m) of flip-flop circuits 21-1 to 21-*m* cascade-arranged, which may be, for example, flip-flops operating at negative-going edges of input pulses, where m=18, for example. The first frequency-divided signal Da having a frequency fa (for example, 8.192 kHz) to be input is sequentially frequency-divided into factors of two, four, six, . . . , and thirty-two by at the respective stages of flip-flop 21-1 to 21-*m*, so that the second frequency-divided signal Db of 4.096 kHz, 2.048 kHz, 1.024 KHz, . . . , 1/16 Hz (16 seconds), and 1/32 Hz (32 seconds) are respectively output from the first stage of flip-flop 21-1 , the second stage of flip-flop 21-2, the third stage of flip-flop 21-3, . . . , the (m−1)th stage of flip-flop 21-(*m*−1), and the final stage of flip-flop 21-*m*.

Figure 4:
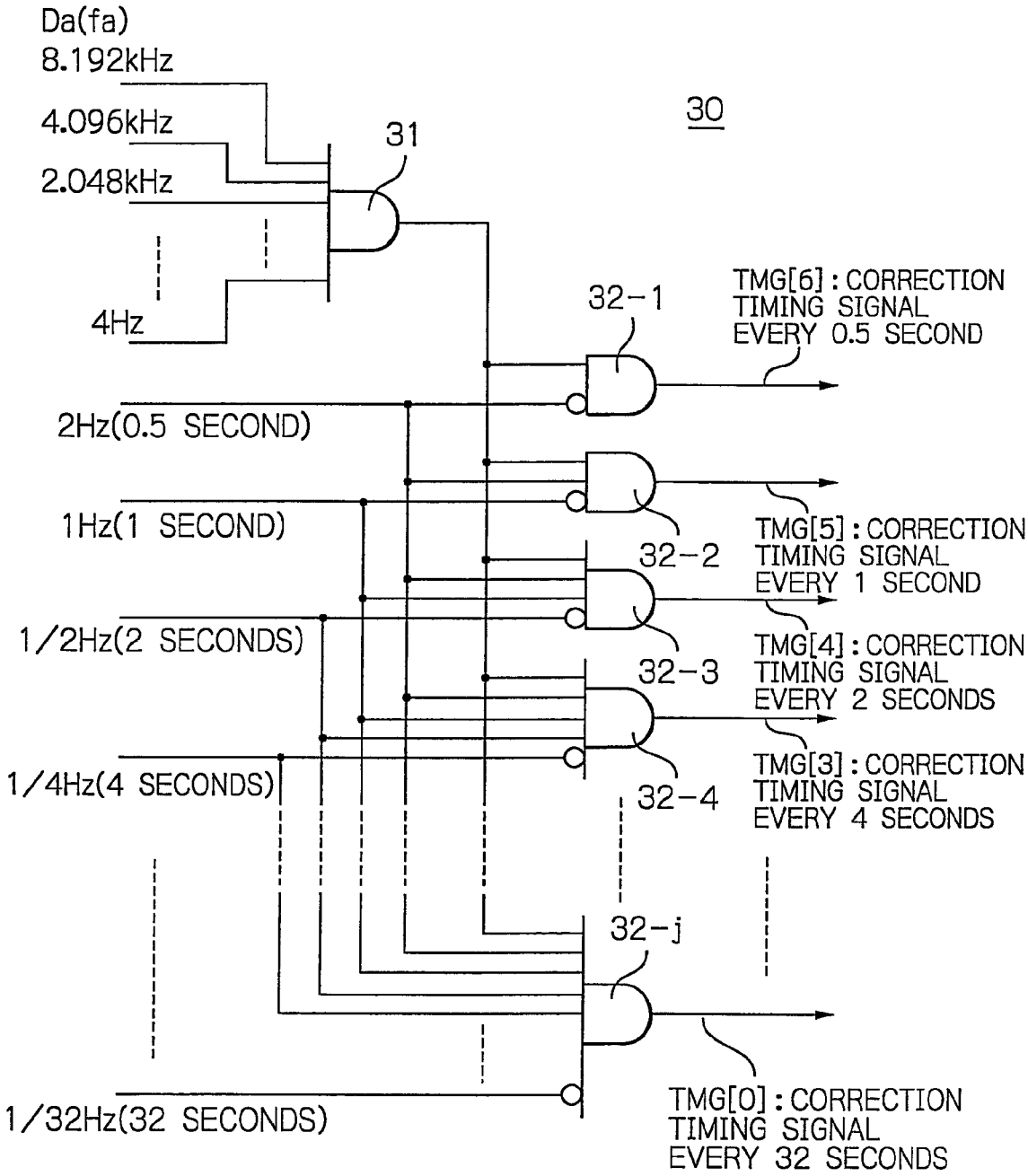
FIG. 4 is a schematic circuit diagram showing a configuration example of the correction timing generator shown in FIG. 1B.

Now, with reference to FIG. 4, which schematically shows in a circuit diagram a configuration example of the correction timing generator 30 shown in FIG. 1B, the correction timing generator 30 is composed of logic circuits, such as AND gates 31, 32-1 to 32-*j*, which are adapted to derive a logic of, i.e. decodes, the first frequency-divided signal Da having the frequency fa (for example, about 8.192 kHz) and the second frequency-divided signal Db having the frequency fb (for example, about 4.096 kHz to 1/32 Hz) to generate j-bit (for example, 7-bit) correction timing signals TMG[6] to TMG [0]. The logic circuits are configured such that the AND gate 31 finds a logical product from signals with frequencies of 8.192 kHz to 4 Hz, and the respective AND gate 32-1 to 32-*j* develop logical products on the basis of the logical result from the AND gate 31 and the signals having the respective frequencies of 2 Hz, corresponding to a period of 0.5 second, to 1/32 Hz, corresponding to a period of 32 seconds to output 7-bit correction timing signals TMG[6], every 0.5 second, to TMG [0], every 32 seconds, thus different from one another in time. The respective correction timing signals TMG[6] to TMG[0] are set so as not to overlap with one another when getting to a logical "1".

Figure 5:
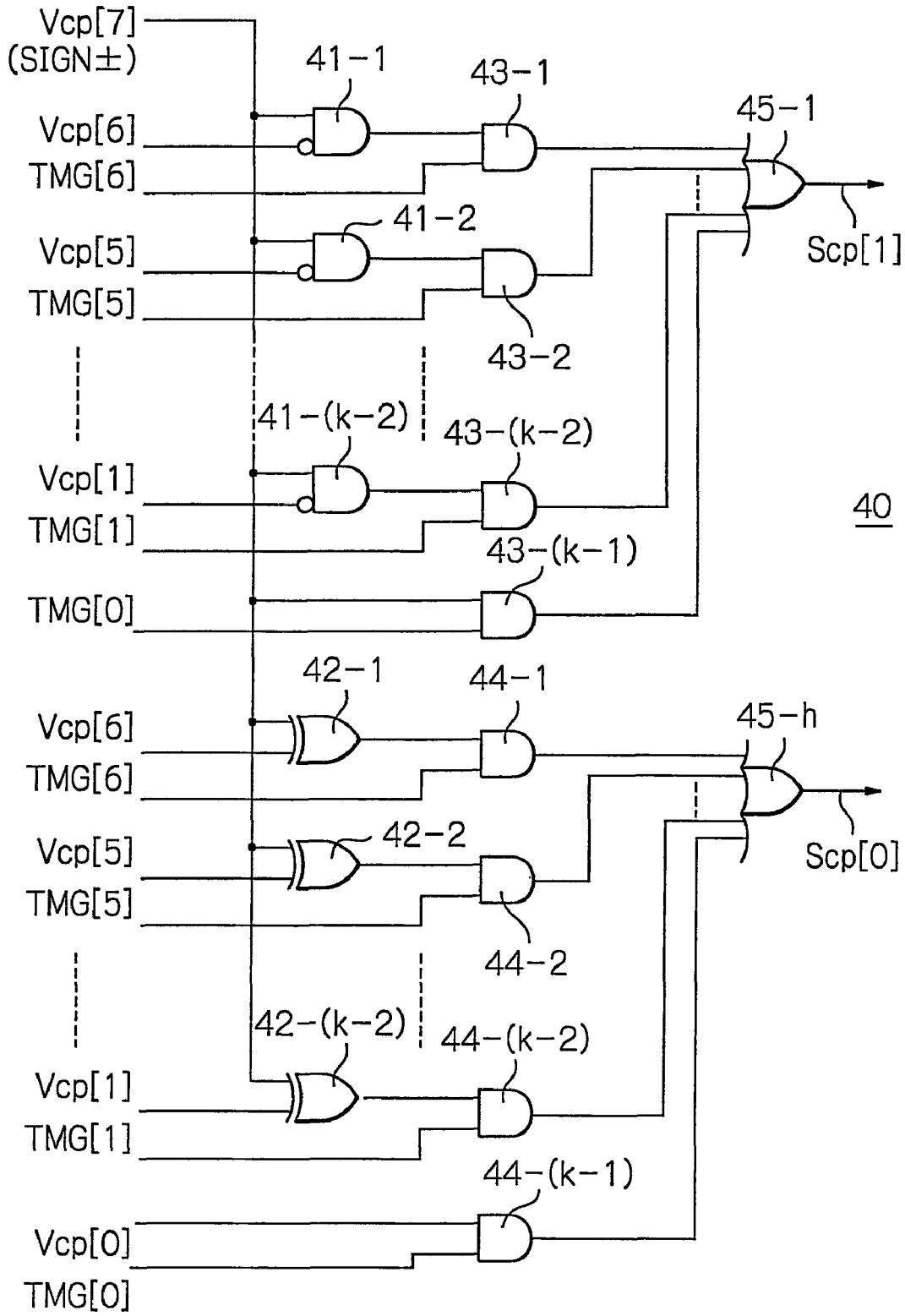
FIG. 5 is a schematic circuit diagram showing a configuration example of the correction signal generator shown in FIG. 1B.

FIG. 5 is a schematic circuit diagram showing a configuration example of the correction signal generator 40 shown in FIG. 1B. The correction signal generator 40 is composed of a logic circuit adapted to derive a logic of j-bit (for example, 7-bit) correction timing signals TMG[6] to TMG[0] and k-bit (for example, 8-bit) correction values Vcp[7] to Vcp[0] to generate h-bit (for example, 2-bit) correction signals Scp[1] and Scp[0], where k is a natural number.

The logic circuit is comprised of, for example, AND gates 41-1 to 41-(*k*−2), EXOR gates 42-1 to 42-(*k*−2), AND gates 43-1 to 43-(*k*−1) and 44-1 to 44-(*k*−1), and OR gates 45-1 and 45-*h*. In the logic circuit, logical products of the 7th-bit correction value Vcp[7], which selectively represents a positive and a negative sign (±), and the 6th to 1st-bit correction values Vcp[6] to Vcp[1] are found by the respective AND gates 41-1 to 41-(*k*−2), and exclusive ORs are found by the respective EXOR gates 42-1 to 42-(*k*−2). In the circuit, further, logical products of the logical results from the respective AND gates 41-1 to 41-(*k*−2) and the respective EXOR gates 42-1 to 42-(*k*−2) with the respective correction signals TMG[6] to TMG[0] are found by the AND gates 43-1 to 43-(*k*−1) and 44-1 to 44-(*k*−1). Moreover, the logic circuit is configured such that a logical OR of the logical results from the AND gates 43-1 to 43-(*k*−1) is found by the OR gate 45-1 to output the correction signal Vcp[1], and a logical OR of the logical results from the respective AND gates 44-1 to 44-(*k*−1) is found by the OR gate 45-*h* to output the correction signal Vcp[0].

Figure 6:
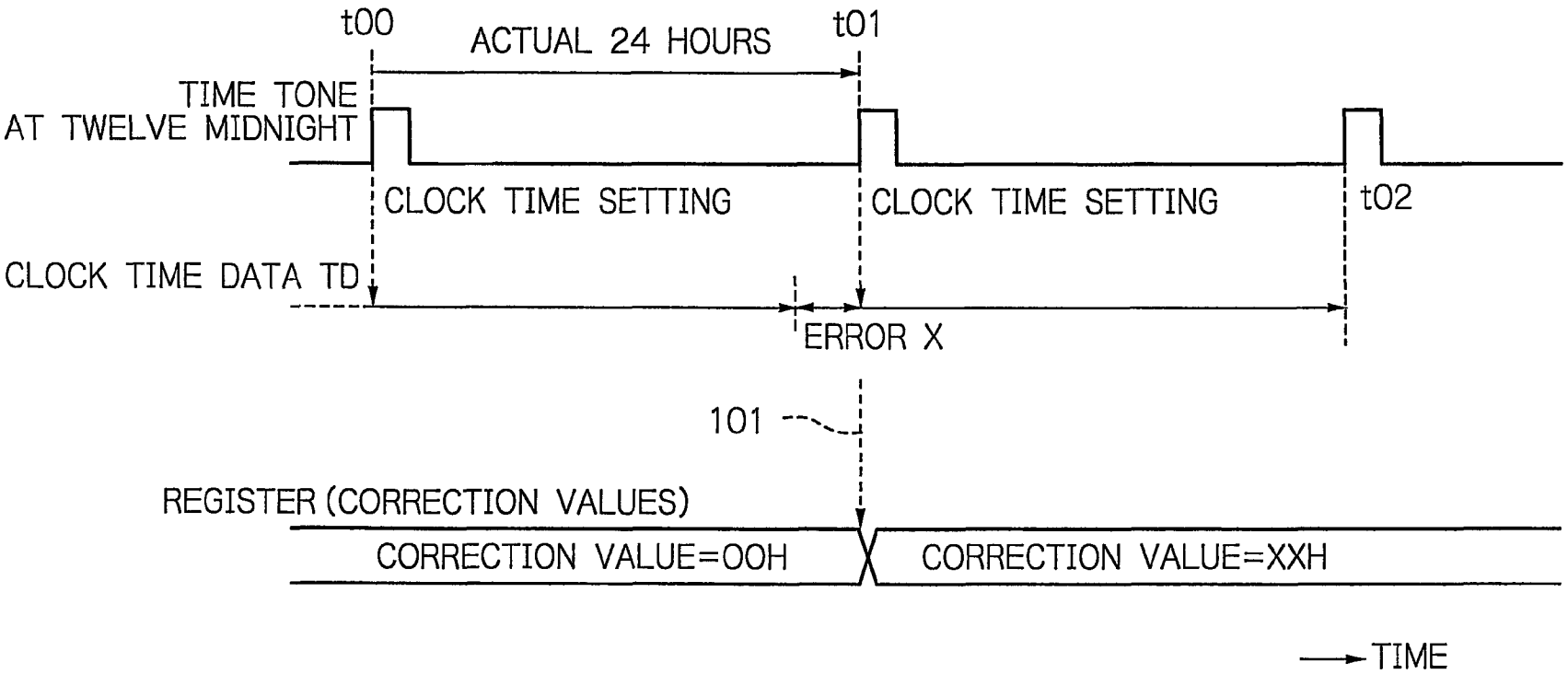
FIG. 6 shows the waveforms in general operation of the clocking apparatus shown in FIG. 1A.

FIG. 6 schematically shows waveforms appearing in operation of the clocking apparatus shown in FIG. 1A. In operation, when, for example, a time tone at twelve midnight is input as reference clock time data IN to the input port 1 at time t01, the reference clock time data IN is transferred to the CPU 2. The CPU 2 finds an error x between the time tone at twelve midnight as the reference clock time data IN in a 24-hour period and the clock time data TD of the clocking counter 3 in a 24-hour period, and then a frequency correction factor (=$10^6$×error x in a 24-hour period) [ppm] and correction values Vcp[7:0] (=Vcp[7] to Vcp[0]) to set the correction values Vcp[7:0] in the correction value register 4, as depicted with a dotted line 101. The frequency corrector 5 is changed in its frequency dividing ratio on the basis of the correction value Vcp, and frequency-divides the clock signal CK of the clock frequency fi (=32.768 kHz) output from the oscillator 6 on the basis of the frequency dividing ratio to generate a unit time signal So (for example, 1 second) at a predetermined clock frequency fo (for example, 1 Hz) to provide it to the clocking counter 3. In the clocking counter 3, the unit time signal So (1 second) is frequency-divided to produce time data TD such as hours, minutes, or seconds to provide the data to the CPU 2. In this operation, for example, the clock time data TD is displayed on a display unit, not shown, under the control of the CPU 2. On the following day after 24 hours, at a time tone at twelve midnight, the clocking apparatus repeats the above-described operation at time t02.

Figure 7A:
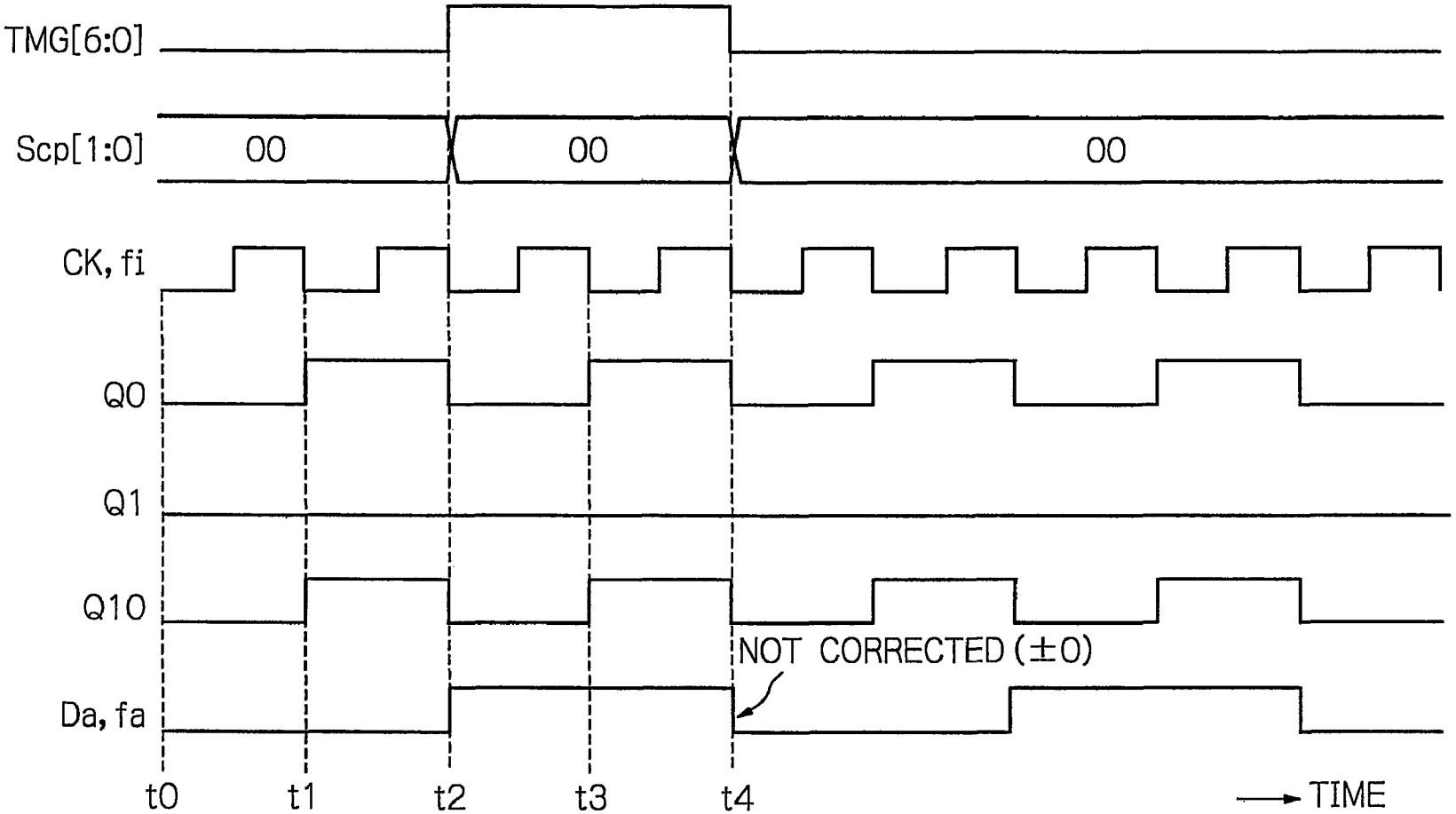
FIGS. 7A, 7B, 7C and 7D show the waveforms in operation of the counter shown in FIG. 2.

FIG. 7A shows the waveforms in operation of the counter shown in FIG. 2 when the correction signal Scp[1:0]=00. This chart shows a state in which a correction for clock pulses is not performed (clock correction value=±0) in the counter 10 in a case of the correction signal Scp[1:0]=00.

In the case in which the correction signal Scp[1:0] is "00", the OR gate 12*a* is opened and the OR gate 12*b* is closed. For example, at the clock time t1, the frequency-divided result Q0 from the flip-flop lid rises to "1" at the negative-going edge of the clock signal CK having a frequency fi (about 32.768 kHz), and at the following clock time t2, the frequency-divided result Q0 from the flip-flop 11*d* falls to "00". Thus, the clock signal CK is frequency-divided into a fraction of two by the flip-flop 11*d*. In turn, the selected result Q10 from the AND gate 12*c* through the OR gate 12*a* comes to "1" during the period of clock times t1 to t2.

In the same way, in the period of clock times t2 to t4 when any one of the correction timing signals TMG[6] to TMG[0] comes to "1", during a time from the negative-going edge of the clock signal CK at the clock time t3 to the negative-going edge of the clock signal CK at the clock time t4, the selected result Q10 is "1". The frequency-divided result Da output from the flip-flop 13*b* through the EXOR gate 13*a* rises to "1" at the negative-going edge of the selected result Q10 at the clock time t2, and the frequency-divided result Da falls to "0" at the negative-going edge of the selected result Q10 at following clock time t4. Then, the selected result Q10 is frequency-divided into a fraction of two, i.e. halved, by the flip-flop 13*d*.

Accordingly, in the period of clock times t2 to t4 in which any one of the correction timing signals TMG[6] to TMG[0] comes to "1", if the correction signal Scp[1:0] is "00", then the clock signal CK is frequency-divided into a fraction of four by the counter 10, and a correction is not performed on the clock pulses (a clock correction value=±0), so that the signal is output directly as the frequency-divided signal Da to the frequency divider circuit 20.

Figure 7B:
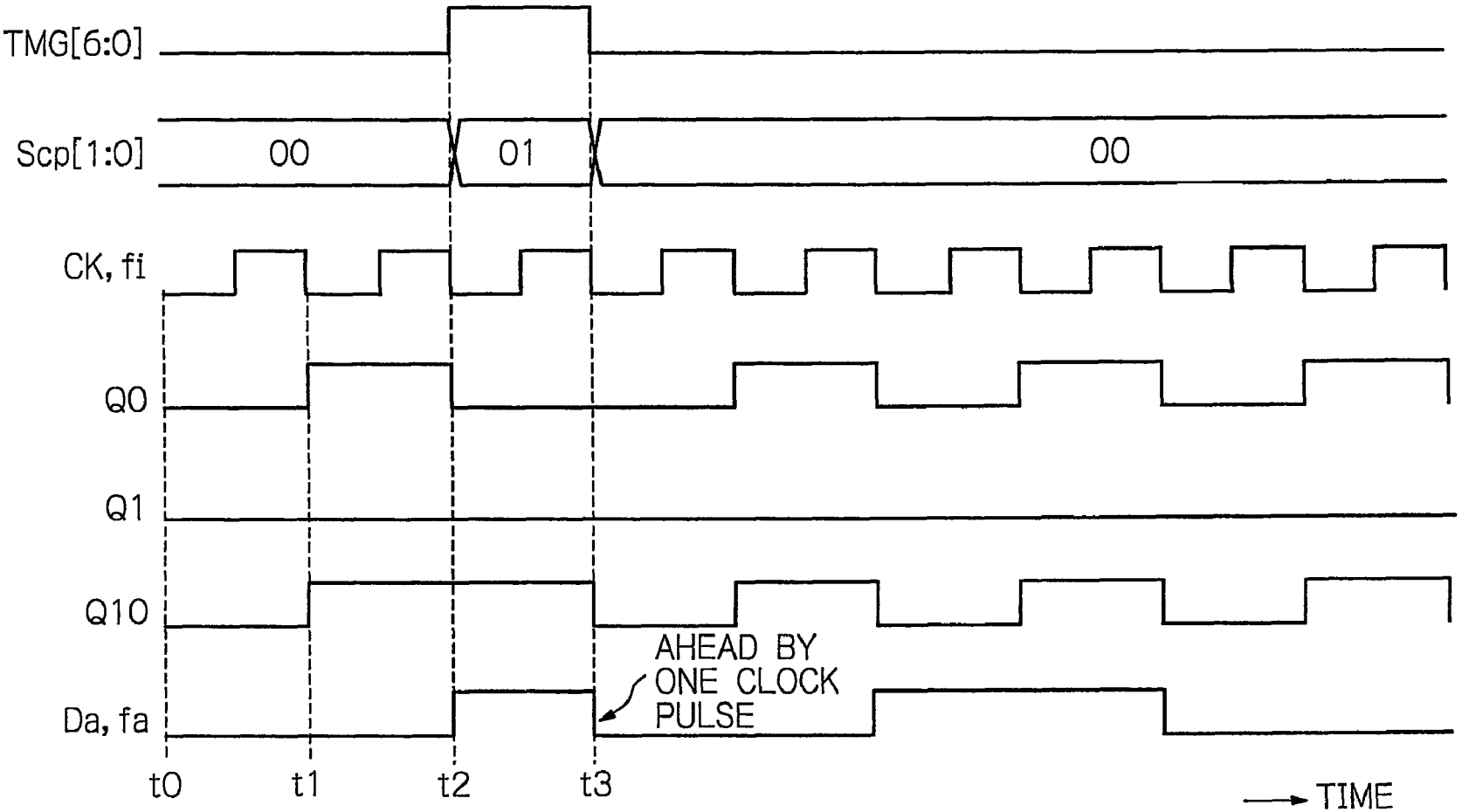

FIG. 7B shows the waveforms in operation of the counter shown in FIG. 2 at a time at which the correction signal Scp[1:0]=01. This chart shows a state in which, in a case of the correction signal Scp[1:0]=01, the counter 10 performs a correction to make the signal ahead by a period corresponding to one pulse (clock correction value=±1).

In the case in which a frequency correction is performed on the clock signal CK, when the correction timing signals TMG [6:0] (TMG[6] to TMG[0]) are "1" during the period of clock times t2 to t3, a correction signal Scp[1:0] (="01") is provided from the correction signal generator 40. In this operation, the OR gates 12*a* and 12*b* are closed, and the selected result Q10 from the AND gate 12*c* comes to "1", so that the frequency-divided signal Da output from the flip-flop 13*b* comes to "1". Therefore, the frequency-divided signal Da is output from the flip-flop 13*b* ahead by a period corresponding to one clock pulse of the clock signal CK.

Figure 7C:
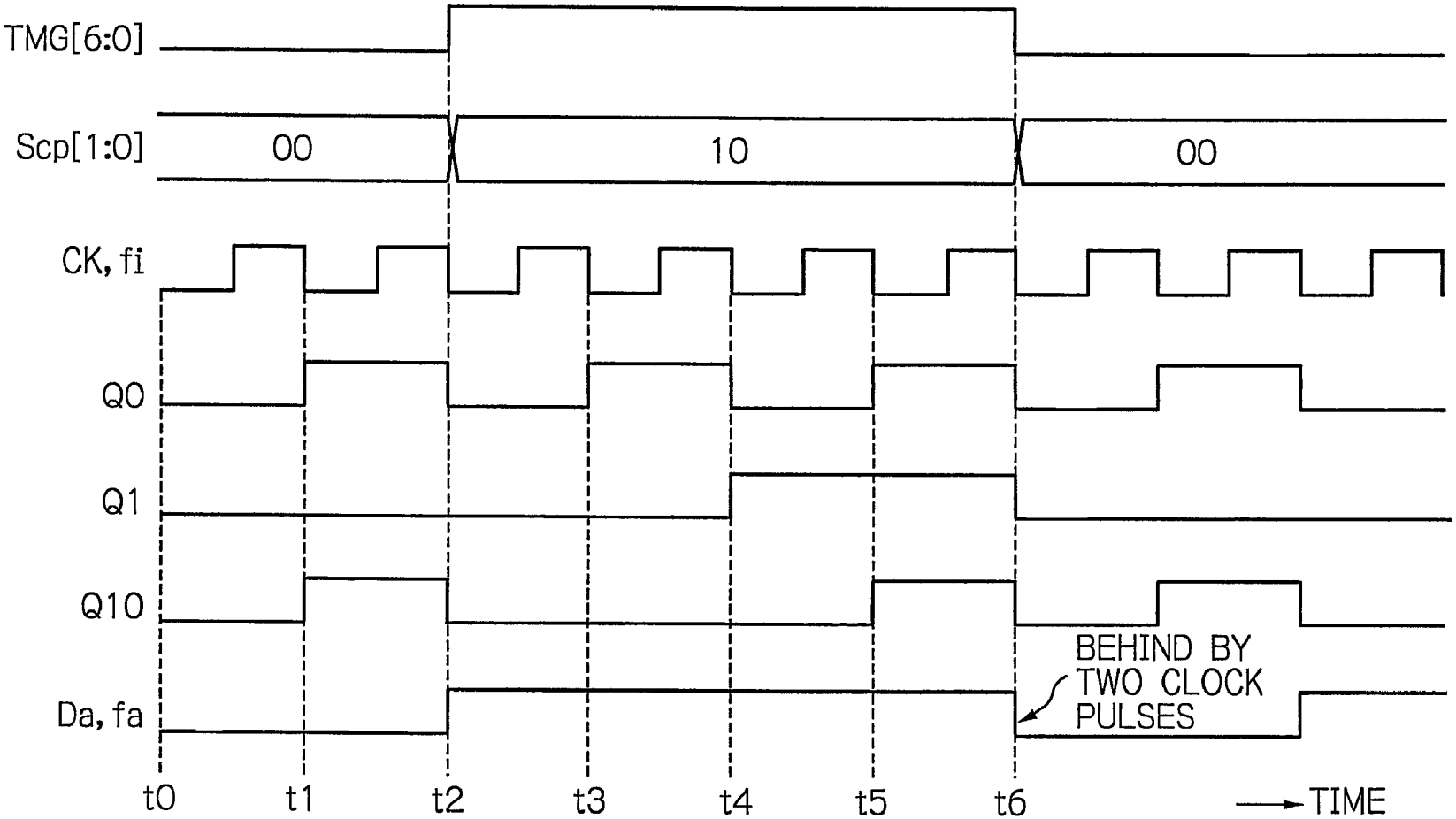

FIG. 7C similarly shows the waveforms in operation of the counter shown in FIG. 2 at a time at which the correction signal Scp[1:0]=10. This chart shows a state in which, in a case of the correction signal Scp[1:0]=10, the counter 10 performs a correction to make signal is behind by a period corresponding to two clock pulses (a clock correction value=−2).

In the case in which a frequency correction is performed on the clock signal CK, when the correction timing signals TMG [6:0] (TMG[6] to TMG[0]) are "1" during the period of clock times t2 to t6, a correction signal Scp[1:0] (="10") is provided from the correction signal generator 40. In this operation, the OR gates 12*a* and 12*b* are opened, and the selected result Q10 from the AND gate 12*c* comes to "0". The selected result Q10 comes to "1" during the period of clock times t5 to t6. Thus, the frequency-divided signal Da output from the flip-flop 13*b* comes to "1". Therefore, the frequency-divided signal Da is output from the flip-flop 13*b* behind by a period corresponding to two clock pulses of the clock signal CK.

Figure 7D:
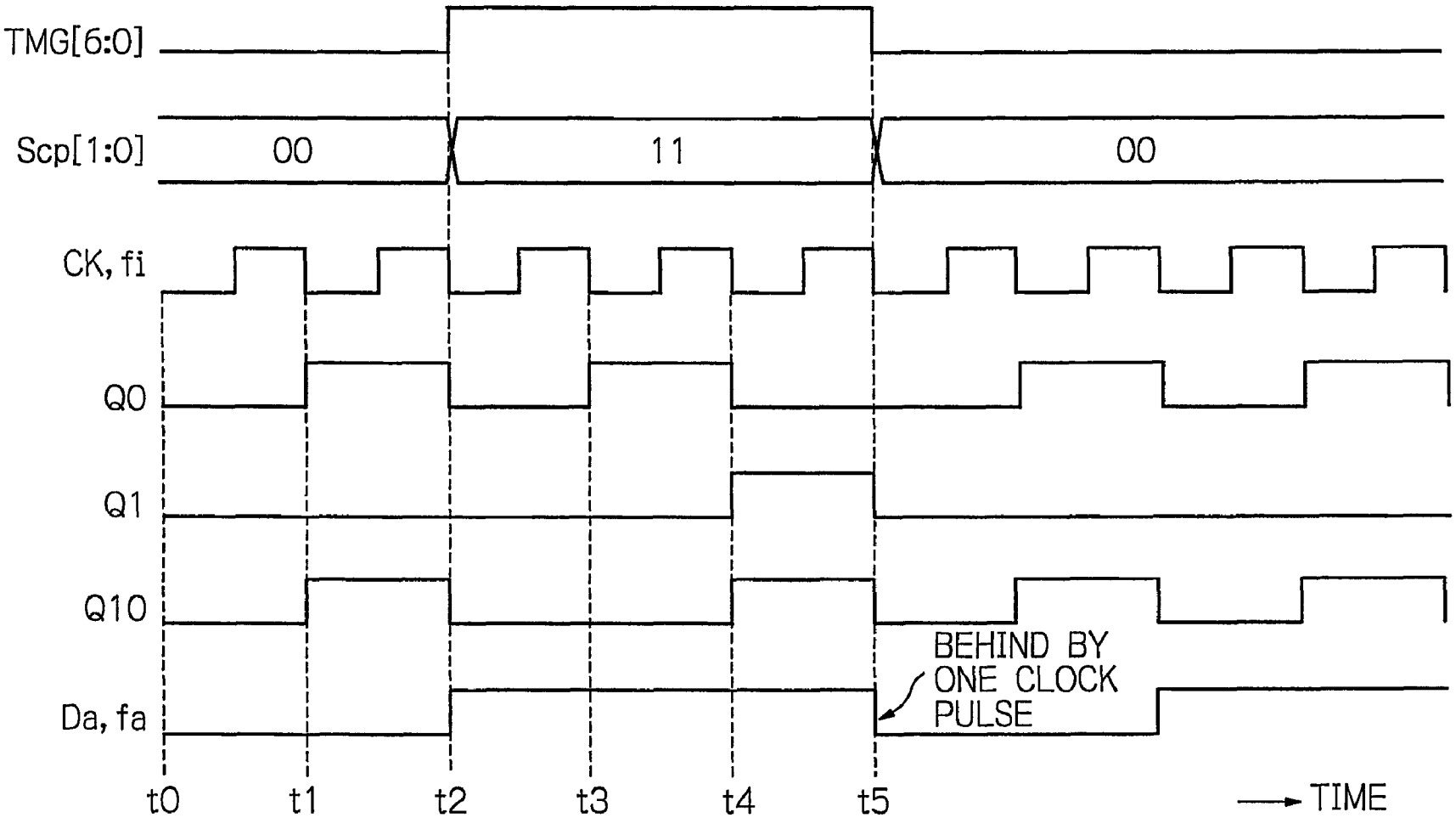

FIG. 7D shows the waveforms in operation of the counter also shown in FIG. 2 at a time at which the correction signal Scp[1:0]=11. This chart shows a state in which, in a case of the correction signal Scp[1:0]=11, a correction is performed by the counter 10 to make the signal behind by a period corresponding to one clock pulse (a clock correction value=−1).

In the case in which a frequency correction for the clock signal CK is performed, when the correction timing signals TMG[6:0] (TMG[6] to TMG[0]) are "1" during the period of clock times t2 to t6, a correction signal Scp[1:0] (=11) is provided from the correction signal generator 40. In this operation, the OR gate 12*a* is closed and the OR gate 12*b* is opened, and the selected result Q10 from the AND gate 12*c* comes to "0" during the period of clock times t2 to t4. The selected result Q10 comes to "1" during the period of clock times t4 to t5, so that the frequency-divided signal Da output from the flip-flop 13*b* comes to "1". Thus, the frequency-divided signal Da is output from the flip-flop 13*b* behind by a period corresponding to one clock pulse of the clock signal CK.

Operation of the frequency divider circuit 20 and the correction timing generator 30 in the frequency corrector 5 will be described with reference to FIG. 8, which shows waveforms in operation of the frequency divider circuit 20 and the correction timing generator 30 shown in FIGS. 3 and 4, respectively.

In the frequency divider circuit 20, the frequency-divided signal Da having its clock frequency fa (≈8.192 kHz signal) output from the counter 10 is frequency-divided by the binary counter to generate frequency-divided signals Db with a plurality of clock frequencies fb (=4.096 kHz to 1/32 Hz, corresponding to the 32-second cycle), and the frequency divider circuit 20 outputs the frequency-divided signals Db to the correction timing generator 30. In the correction timing generator 30, the correction timing signals TMG[6] (every 0.5 second) to TMG[0] (every 32 seconds) are generated in response to the frequency-divided signal Da having its clock frequency fa (≈8.192 kHz signal) and the plurality of clock frequencies fb (=4.096 kHz to 1/32 Hz) to be output to the correction signal generator 40. The correction timing signals TMG[6] to TMG[0] are set so as not to overlap with one another in clock time for output.

Figure 8:
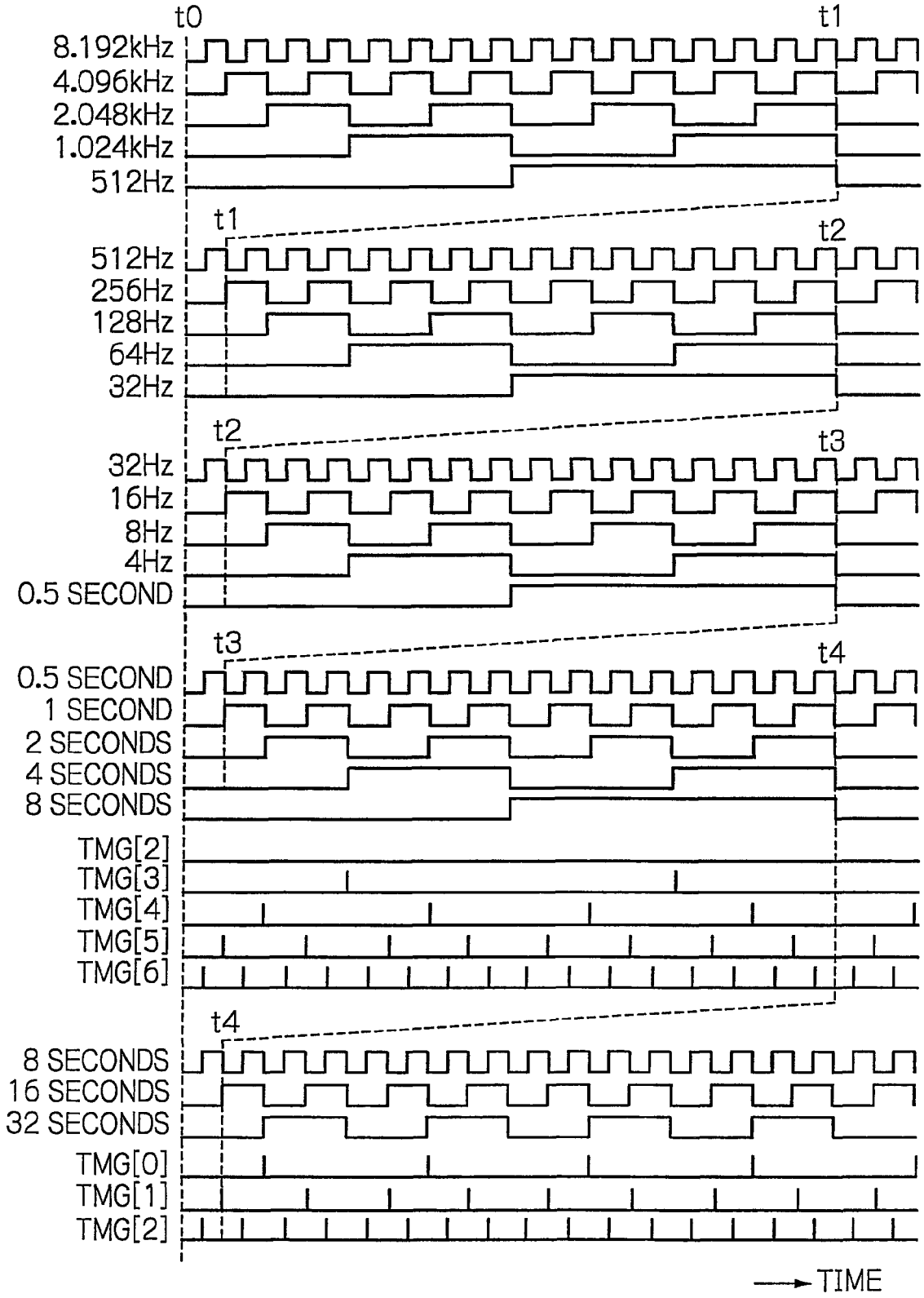
FIG. 8 shows waveforms in operation of the frequency divider circuit shown in FIG. 3 and the correction timing generator shown in FIG. 4.

In FIG. 8, a time from the clock time t0 to the clock time t1 denotes one cycle of a 512 Hz signal, a time from the clock time t0 to the clock time t2 denotes one cycle of a 32 Hz signal, a time from the clock time t0 to the clock time t3 denotes one cycle of a 0.5 second (2 Hz) signal, and a time from the clock time t0 to the clock time t4 denotes one cycle of an 8 second (1/8 Hz) signal.

The correction timing signal TMG[6] is output during the period in which the 8.192 kHz signal to the 4 Hz signal are all "1" immediately before the 0.5 second (2 Hz) signal comes to "1", i.e. when the 0.5 second signal is "0". The correction timing signal TMG[5] is output during the period in which the 8.192 kHz signal to the 0.5 second (2 Hz) signal are all "1" immediately before the 1-second (1 Hz) signal comes to "1", i.e. when the 1-second signal is "0". The correction timing signal TMG[4] is output during the period in which the 8.192 kHz signal to the 1-second signal are all "1" immediately before the 2-second (1/2 Hz) signal comes to "1", i.e. when the 2-second signal is "0". The correction timing signal TMG[3] is output during the period in which the 8.192 kHz signal to the 2-second signal are all "1" immediately before the 4-second (1/4 Hz) signal comes to "1", i.e. when the 4-second signal is "0".

The correction timing signal TMG[2] is output during the period in which the 8.192 kHz signal to the 4-second signal are all "1" immediately before the 8-second (1/8 Hz) signal comes to "1", i.e. when the 8-second signal is "0". The correction timing signal TMG[1] is output during the period in which the 8.192 kHz signal to the 8-second signal are all "1" immediately before the 16-second (1/16 Hz) signal comes to "1", i.e. when the 16-second signal is "0". The correction timing signal TMG[0] is output during the period in which the 8.192 kHz signal to the 16-second signal are all "1" immediately before the 32-second (1/32 Hz) signal comes to "1", i.e. when the 32-second signal is "0".

Well, FIG. 9 lists the frequencies of occurrence of the correction timing signals TMG[6:0] output from the correction timing generator 30 shown in FIG. 4. For example, the correction timing signal TMG[0] is, as seen from the output timing shown in FIG. 8, generated at a frequency of once per 32 seconds, i.e. during the time when the 32-second signal is "0" and immediately before the 32-second signal comes to "0". In the same way, the correction timing signal TMG[6] is generated at a frequency of once per 0.5 second.

Operation of the correction signal generator 40 in the frequency corrector 5 will be described. In the correction signal generator 40, a correction signal Scp[1:0] is generated in response to the correction timing signals TMG[6:0] generated in the correction timing generator 30 and a value of the correction value [7:0] to be output to the counter 10.

FIG. 10 shows the relationship among the correction values Vcp[7:0] and the frequency correction factors [ppm] In the column of correction values [7:0], a sign bit(±) indicates the 7th-bit correction value Vcp[7]. The bit6 to bit0 indicate the 6th-bit correction value Vcp[6] to the 0-bit correction value Vcp[0], respectively. In the column of hexadecimal numbers, the hexadecimal notation "FFH", for example, means that all the correction values Vcp[7] to Vcp[0] (Vcp [7:0]) indicate "1". That also means that the frequency correction factor [ppm] at that time indicates −0.95.

In the correction signal generator 40 shown in FIG. 5, for example, in a case in which the correction value Vcp[6] is "1" and the reference symbol for the correction value Vcp[7] is +("0"), a value "01" is output to the correction value Vcp [1:0] at the timing of generating the correction timing signal TMG[6]. In this operation, in the counter 10, a frequency correction is performed by which the frequency-divided signal Da having its clock frequency fa (=8.192 kHz signal) is made ahead by a period corresponding to one clock pulse of the clock signal CK having its clock frequency fi (=32.768 kHz). In this case, because the correction timing signal TMG [6] is a signal generated at a frequency of once per 0.5 second, the duration of 16.383 clock pulses of the clock signal CK at 32.768 kHz is 0.5 second. As a result, the frequency is corrected with a frequency correction factor of about +61 ppm (≈30.518 μs/0.5s×$10^6$) In a case in which the correction value Vcp[6] is "0", a value "00" is output to the correction signal [1:0], and thus a correction is not performed by the counter 10.

In a case in which the correction value Vcp[6] is "0" and the reference symbol for the correction value Vcp[7] is −("1"), a value "11" is output to the correction value Vcp[1:0] at the timing of generating the correction timing signal TMG[6]. In this operation, the counter 10 makes the 8.192 kHz signal behind by a period corresponding to one clock pulse of the clock signal CK at 32.768 kHz. Because the correction timing signal TMG[6] is a signal generated at a frequency of once per 0.5 second, the duration of 16,385 clock pulses of the clock signal CK at 32.768 kHz is 0.5 second. As a result, the frequency is corrected with a frequency correction factor of about −61 ppm (≈−30.518 μs/0.5s×$10^6$). Further, in a case in which the correction value Vcp[6] is "0", a value "00" is output to the correction signal [1:0], and thus a correction is not performed by the counter 10.

For the correction values Vcp[5] to Vcp[1], the operations proceed in the same way as the correction value Vcp[6]. In a case in which the correction value Vcp[0] is "1" and the reference symbol for the correction value Vcp[7] is +("0"), a value "01" is output to the correction value Vcp[1:0] at the timing of generating the correction timing signal TMG[0], and the counter 10 makes the 8.192 kHz signal ahead by a period corresponding to one clock pulse of the clock signal CK at 32.768 kHz. Because the correction timing signal TMG [0] is a signal generated at a frequency of once per 32 seconds, the duration of 1,048,575 clock pulses of the clock signal CK at 32.768 kHz is 32 seconds. As a result, the frequency is corrected with a frequency correction factor of about +0.95 ppm (≈30.518 μs/32s×$10^6$). Further, in a case in which the correction value Vcp[0] is "0", a value "00" is output to the correction signal Scp[1:0], and thus a correction is not performed by the counter 10.

In a case in which the correction value Vcp[0] is "1" and the reference symbol for the correction value Vcp[7] is −("1"), a value "11" is output to the correction value Scp[1:0] at the timing of generating the correction timing signal TMG[0], and the counter 10 makes the 8.192 kHz signal behind by a period corresponding to one clock pulse of the clock signal CK at 32.768 kHz. Because the correction timing signal TMG [0] is a signal generated at a frequency of once per 32 seconds, the duration of 1,048,577 clock pulses of the clock signal CK at 32.768 kHz is 32 seconds. As a result, the frequency is corrected with a frequency correction factor of about −0.95 ppm (≈30.518 μs/32s×$10^6$). Further, in a case in which the correction value Vcp[0] is "0", a value "10" is output to the correction signal Scp[1:0], and the counter 10 makes the 8.192 kHz signal behind by a period corresponding to two clock pulses of the clock signal CK at 32.768 kHz. Because the correction timing signal TMG[0] is a signal generated at a frequency of once per 32 seconds, the duration of 1,048,578 clock pulses of the clock signal CK at 32.768 kHz is 32 seconds. As a result, the frequency is corrected with a frequency correction factor of about −1.91 ppm (≈30.518 μs×2 clocks/32s×$10^6$).

Because the correction timing signals TMG[6:0] are set so as to be not simultaneously generated, as shown in FIG. 10, corrections at the resolution of 0.95 ppm are possible within a range from about −122.1 ppm−+121.1 ppm on the basis of the value of the correction value [7:0].

Hereinafter, actual frequency correction examples (a), (b) and (c) will be described.

(a) A case of the correction values [7:0]="0_0000001b" ("01H")

Because the correction value Vcp[7] (reference symbol) is +("0") and only the 0th-bit correction value Vcp[0] is "1", only in a case of the correction timing signal TMG[0] (every 32 seconds), the counter 10 makes the 8.192 kHz signal ahead by a period corresponding to one clock pulse (a cycle of about 30.5 μs) of the clock signal CK at 32.768 kHz. Therefore, the frequency is ahead with a frequency correction factor of about +0.95 ppm, which is approximately equal to (30.518 μs×1 clock×1 time)/32s×$10^6$.

(b) A case of the correction values [7:0]="0_0000101b" ("05H")

Because the correction value Vcp[7] (reference symbol) is +("0") and both the 2nd-bit correction value Vcp[2] and the 0th-bit correction value Vcp[0] are "1", every time the correction timing signal TMG[2] every eight seconds and the correction timing signal TMG[0] every 32 seconds are generated, the counter 10 makes the 8.192 kHz signal ahead by a period corresponding to one clock pulse (a cycle of about 30.5 μs) of the clock signal CK at 32.768 kHz. Therefore, because the correction timing signal TMG[2] and the correction timing signal TMG[0] are generated four (=32 seconds/8 seconds) times and one (=32 seconds/32 seconds) time, respectively, the frequency is ahead with a frequency correction factor of about +4.77 ppm, which is approximately equal to (30.518 μs×1 clock×(4+1) times)/32s×$10^6$.

(c) A case of the correction values [7:0]="1_110110b" ("06H")

Because the correction value Vcp[7] (reference symbol) is −("1") and both the 3rd-bit correction value Vcp[3] and the 0th-bit correction value Vcp[0] are "0", every time the correction timing signal TMG[3] is generated for every four seconds, the counter 10 makes the 8.192 kHz signal behind by a period corresponding to one clock pulse (a cycle of about 30.5 μs) of the clock signal CK at 32.768 kHz. Further, every time the correction timing signal TMG [0] every 32 seconds is generated, the counter 10 makes the 8.192 kHz signal behind by a period corresponding to two clock pulses (a cycle of about 61 μs) of the clock signal CK at 32.768 kHz. Therefore, the correction timing signal TMG[3] and the correction timing signal TMG[0] are generated eight (=32 seconds/4 seconds) times and one (=32 seconds/32 seconds) time, respectively, the frequency is behind with a frequency correction factor of about −9.54 ppm, which is approximately equal to ((−30.518 μs×1 clock×8 times)+(−30.518 μs×2 clocks×1 time))/32s×$10^6$.

In this way, it is possible to correct all the signals of the 8.192 kHz signal to 1/32 Hz, corresponding to 32-second cycle, including the unit time signal, i.e. 1-second (1 Hz) signal, for the clocking apparatus in accordance with the values set as the correction values Vcp[7:0].

According to the first illustrative embodiment, the correction timing signals TMG[6] to TMG[0] for performing frequency corrections are set so as not to overlap with one another in output timing, and the frequency corrections are performed in response to the 2-bit correction signals Scp[1:0] by the counter 10 to generate the frequency-divided signal Da having a frequency fa (=about 8.192 kHz), thus causing the following advantages (a) to (d).

(a) Because all the signals are corrected up to the 32-second (1.32 Hz) signal on and after the signal at about 8.192 kHz in which the clock signal CK at about 32.768 kHz is frequency-divided by the counter 10, it is possible to use the signals on and after the signal at about 8.192 kHz for a peripheral circuit such as a timer for stopwatch. Namely, according to the clocking apparatus of the first embodiment, because the apparatus is configured to generate the clock time data TD by the clocking counter 3 in response to a unit time signal So output from the frequency corrector 5, in a case in which the unit time signal So is used as an actuating clock signal for a timer for stopwatch or the like, accurate clocking by a stopwatch or the like is accomplished.

(b) An increase in number of bits of the correction values Vcp[7:0] and the correction timing signals TMG[6:0] are increased easily makes it possible to perform a broad range of frequency corrections.

(c) An increase in the maximum cycle (which has been described as 32 seconds in the embodiment 1) of the frequency divider circuit 20 makes it possible to perform more accurate frequency corrections.

(d) Because the frequency corrections are performed by the counter 10 with a smaller frequency dividing ratio, and the corrected frequencies are divided by the frequency divider circuits with large frequency dividing ratios, the circuit configuration of the entire frequency corrector is simplified to be able to make the circuit scale compacter, which makes it possible to reduce power consumption.

Now, with reference to FIG. 11, which schematically shows in a block diagram a clocking apparatus according to a second, or alternative, embodiment of the present invention, a description will be made on the alternative embodiment. Like components are designated with the same reference numerals.

In the clocking apparatus according to the second embodiment, the input port 1 has its input terminal IN connected to a wave clock receiver 7, and to the CPU 2 serving as operational means clock time data storage means, such as a clock time data register, 8 is connected.

The wave clock receiver 7 is adapted to receive the standard wave of time calibration signal to provide reference clock time data IN carried by the received signal to the CPU 2 via the input port 1. The CPU 2 has a function of finding an error x between the new reference clock time data IN and the clock time data TD from the clocking counter 3 by an operation at the specific time interval that the previous reference clock time data IN (−) is subtracted from new reference clock time data IN provided from the input port 1 to calculate correction values Vcp[7:0] on the basis of the error x and the specific time interval to store the correction values in the correction value register 4. The clock time data register 8 is adapted to store, under the control of the CPU 2, new reference clock time data IN every time the CPU 2 calculates an error x and correction values Vcp[7:0] to provide the previously stored reference clock time data IN (−) to the CPU 2. The configuration of the remaining structural elements may be the same as the first embodiment.

Figure 11:
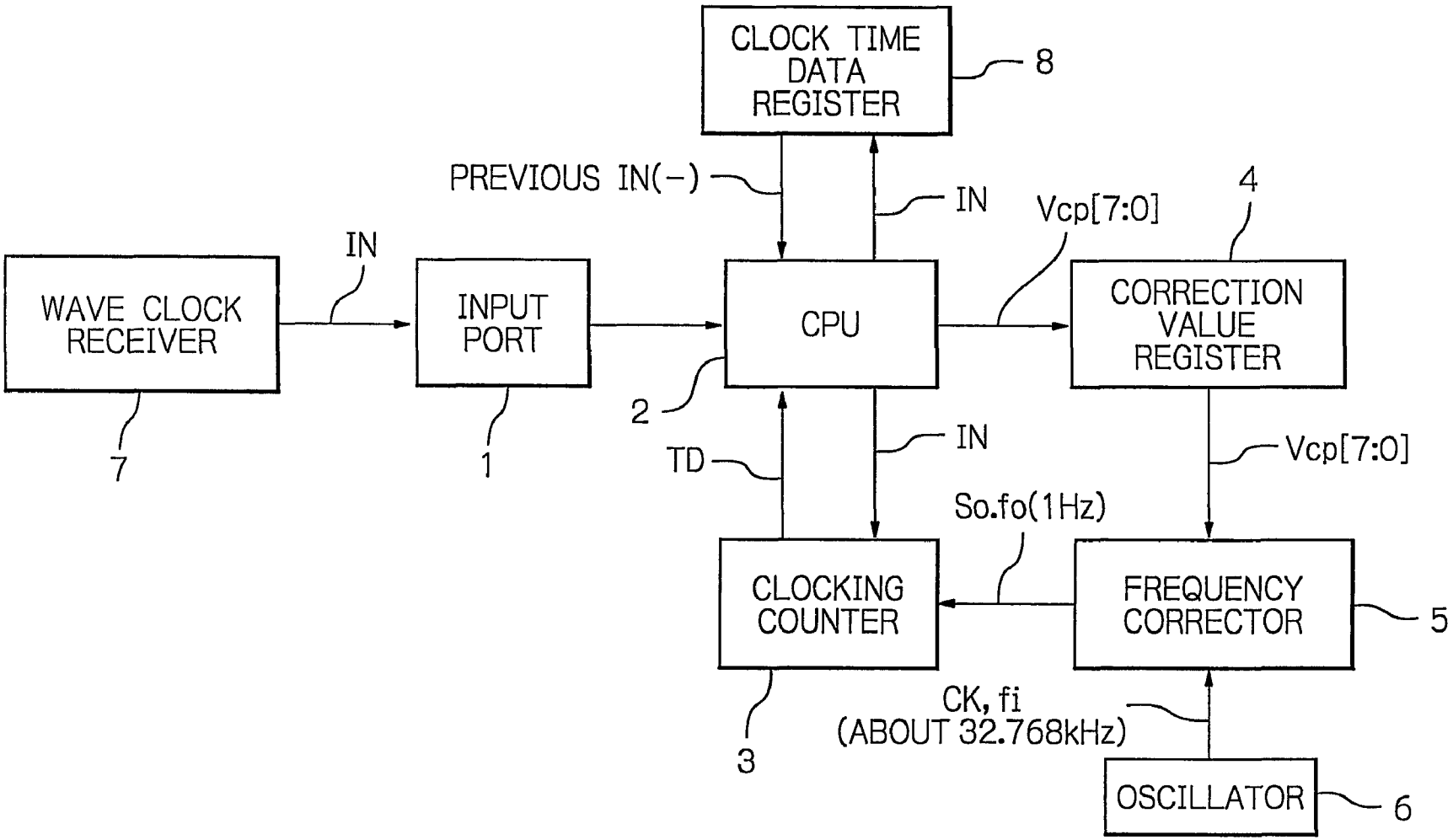
FIG. 11 is a schematic block diagram showing a clocking apparatus according to a second illustrative embodiment of the present invention.
Figure 12:
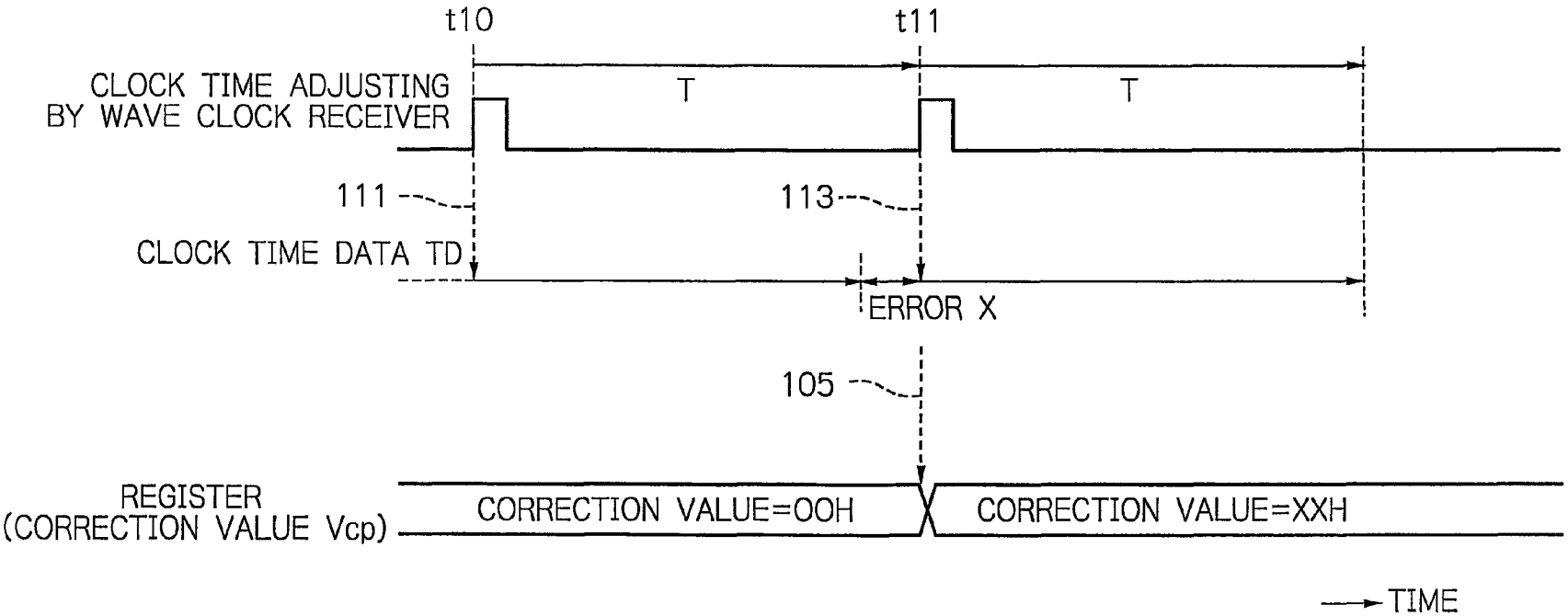
FIG. 12 shows waveforms in general operation of the clocking apparatus shown in FIG. 11.

FIG. 12 is a wave form chart useful for understanding the outline of the operation of the clocking apparatus shown in FIG. 11. For clock time adjusting by the wave clock receiver 7, when the standard wave for time calibration including the reference clock time data IN is received by the wave clock receiver 7 at time t10, the reference clock time data IN carried on the received signal is input to the input port 1 to be transferred to the CPU 2. When the CPU 2 receives the reference clock time data IN, previous clock time is set in the clocking counter 3 and the clock time data register 8 depicted with a dotted line 111. After a specific period of time, when the standard wave including the reference clock time data IN is again received by the wave clock receiver 7 at time t11, the reference clock time data IN in the received signal is input to the input port 1 to be transferred to the CPU 2 as depicted with a dotted line 113, and current clock time is set in the clocking counter 3 and the clock time data register 8 by the CPU 2 as depicted with a dotted line 115.

The CPU 2 uses the previous clock time setting value (=the previous reference clock time data IN (−)) and the current clock time setting value (=the current reference clock time data IN) obtained from the wave clock receiver 7 to find an actual elapsing time T, which corresponds to the current reference clock time data IN minus the previous reference clock time data IN (−). The CPU 2 then finds frequency correction factors on the basis of an error x between the actual elapsing time and the clock time data TD from the clocking counter 3 in accordance with the following expression:

$$\text{Error } x = TD - IN,\ \text{Frequency correction factor [ppm]} = 10^6 \times [\text{error } x/(\text{actual elapsing time})], \quad (1)$$

where TD is clock time data immediately before current clock time data output from the clocking counter 3, and IN is previous clock time data output from the clock time data register 8. Thereafter, the CPU 2 finds correction values Vcp [7:0] for the frequency correction factors to set the values in the correction value register 4, as depicted with a dotted line 115.

When the correction values Vcp[7:0] are set in the correction value register 4, frequency corrections are performed in the same way as in the first embodiment on the basis of the correction values Vcp[7:0].

According to the second embodiment, there are not only the advantages which are substantially the same as the first embodiment, but also advantages as the following (e) (f) and (g) because of the configuration such that the previous reference clock time data IN (−) is stored in the clock time data register 8.

(e) When the frequency corrector 5 is mounted in the clock having a standard wave clock calibration function, it is possible to minimize an error in the clock even when it is impossible to receive waves for a long time.

(f) Because a specific interval for clock time setting at which the reference clock time data IN is input can be set to a shorter period of time, it is possible to obtain an accurate unit time signal So or the like in a short period of time.

(g) When correction values are periodically found by the wave clock receiver 7, it is possible to quickly respond to a change in clock frequency fi of the clock signal CK caused by an environmental change in temperature or the like.

Figure 13:
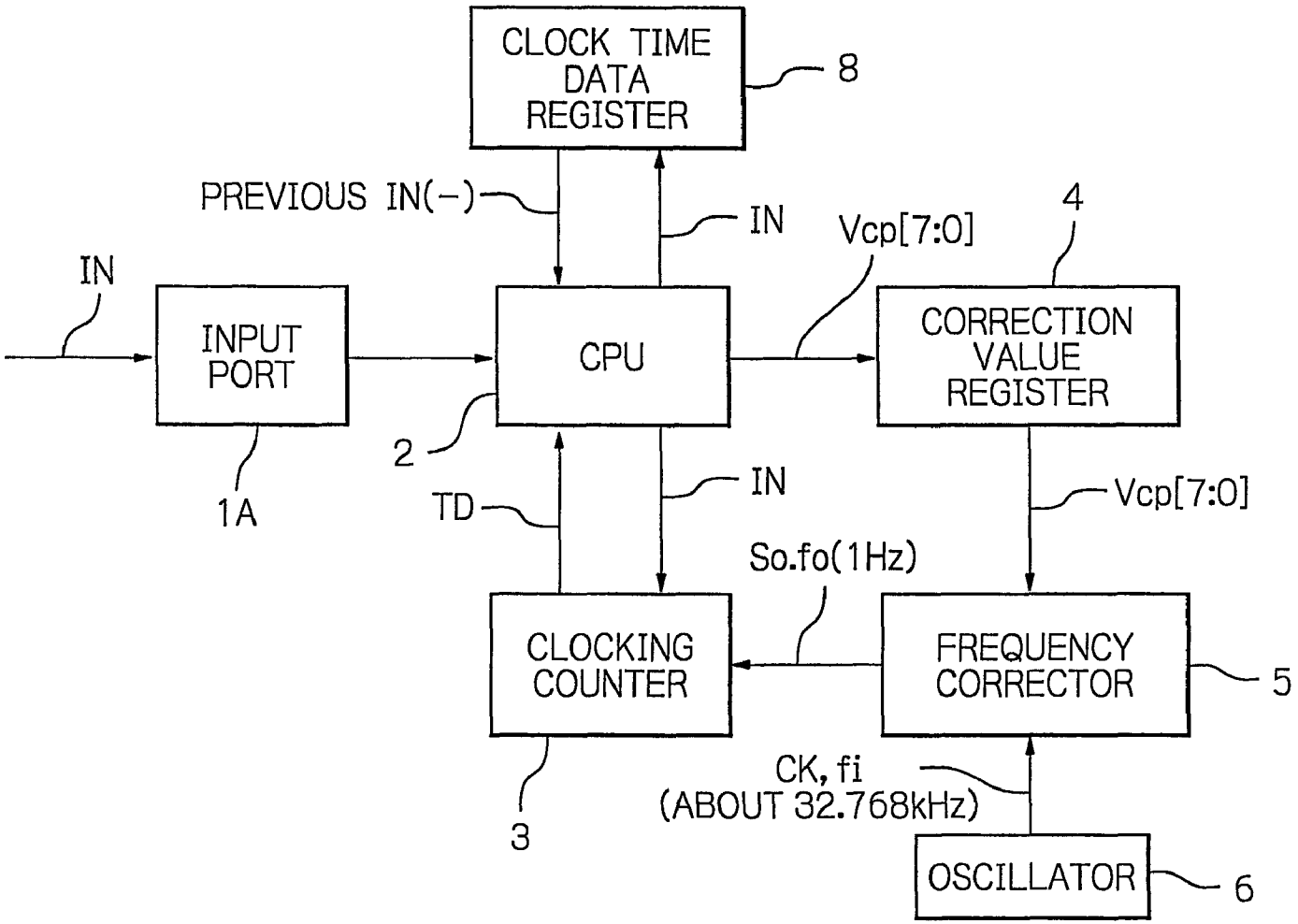
FIG. 13 is a schematic block diagram showing a clocking apparatus according to a third illustrative embodiment of the present invention.

FIG. 13 is a schematic block diagram showing a clocking apparatus according to a third, or further alternative, embodiment of the present invention. The clocking apparatus according to the third embodiment is configured such that the reference clock time data IN is input by clock time setting by a user in place of the wave clock receiver 7 of the second embodiment. Moreover, in place of the input port 1 of the second embodiment, an input port 1A is configured differently from the input port 1. The input port 1A has a function of receiving the reference clock time data IN input by the user to temporarily hold a current clock time setting value, and providing it to the CPU 2. The input port 1A may include a man-machine interface input device, such as switches or keyboard and display, not shown, adapted to be manipulatable by the user. The configuration of the remaining structural components may be the same as the second embodiment.

Figure 14:
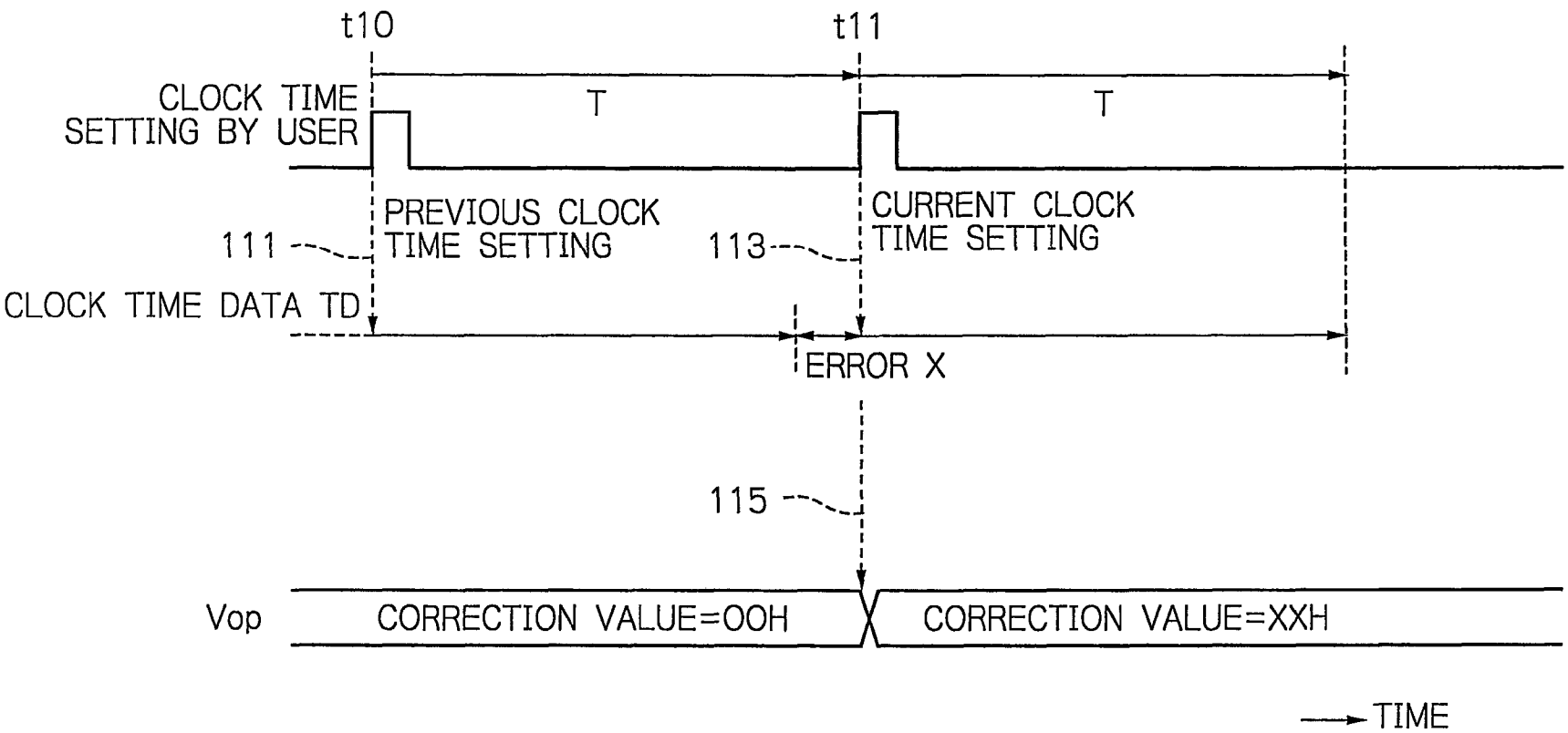
FIG. 14 shows waveforms in general operation of the clocking apparatus shown in FIG. 13.
Figure 15:
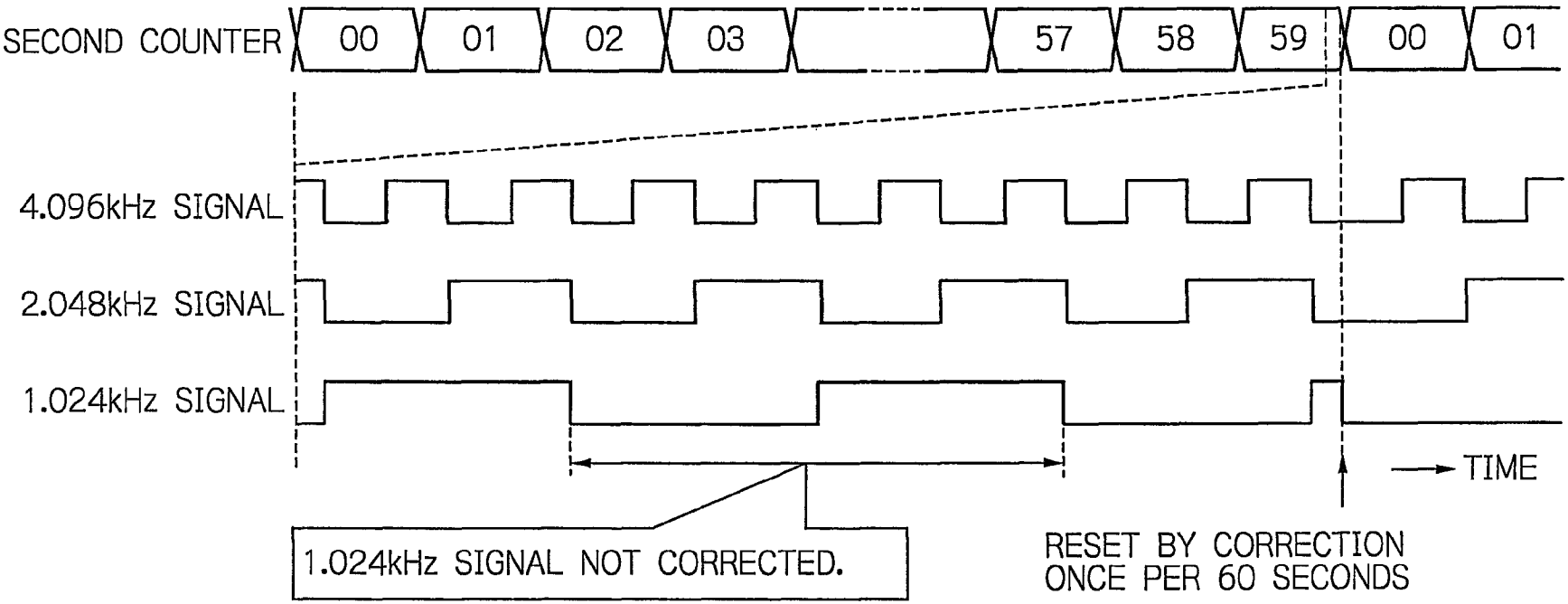
FIG. 15 shows waveforms in general operation of a variable frequency divider circuit in a conventional clocking apparatus.

FIG. 14 is a wave form chart useful for understanding the outline of the operation of the clocking apparatus shown in FIG. 13. When the user operates the switches or the like to set clock time for clock time adjusting at time t10, the reference clock time data IN is input to the input port 1A to be transferred to the CPU 2. When the CPU 2 receives the reference clock time data IN, the previous clock time setting is set in the clocking counter 3 and the clock time data register 8 as depicted with the dotted line 111. After a specific period of time, when the user operates the switches or the like again to set clock time at time t11, the reference clock time data IN is input to the input port 1 to be transferred to the CPU 2 as depicted with the dotted line 113. The current clock time setting is set in the clocking counter 3 and the clock time data register 8 by the CPU 2 as depicted with the dotted line 115.

The CPU 2 uses the previous clock time setting value (=the previous reference clock time data IN (−)) and the current clock time setting value (=the current reference clock time data IN) coming from the clock time setting by the user to find an actual elapsing time T, which corresponds to the current reference clock time data IN minus the previous reference clock time data IN (−). The CPU 2 finds, in the same way as in the second embodiment, frequency correction factors on the basis of an error x between the actual elapsing time and the clock time data TD from the clocking counter 3 in accordance with the expression (1) stated above. Thereafter, the CPU 2 finds correction values Vcp[7:0] for the frequency correction factors to set the values in the correction value register 4, as depicted with the dotted line 115.

When the correction values Vcp[7:0] are set in the correction value register 4, frequency corrections are performed in the same way as in the second embodiment on the basis of the correction values Vcp[7:0].

The third embodiment is configured such that the user may input the reference time data IN, so that there are advantages substantially the same as the first embodiment, but also the following advantages (h) and (i).

(h) Because it is possible for the user to set clock time to any desired time, the apparatus is easy to use.

(b) It is possible to obtain a highly accurate unit time signal So without using means for inputting the reference clock time data IN such as a time calibration standard wave clock receiver.

The present invention is not limited to the above-described specific illustrative embodiments, but various using modes and modifications are possible. There may be the following various modes and modifications (1) to (9), for example.

(1) The embodiments described above are such that the maximum cycle of the correction timing signals TMG is 32 seconds, and the frequency correction accuracy of the clock signal CK at 32.768 kHz is 0.95 ppm. However, in order to increase the frequency correction accuracy to 0.48 ppm or 0.24 ppm, the maximum cycle of the correction timing signals TMG may be increased to 64 or 128 seconds.

(2) The embodiments described above are such that the maximum cycle of the correction timing signals TMG[6:0] is 32 seconds, and the correction values Vcp have an 8-bit length, the correction-available range being within about ±122 ppm. However, in order to increase the frequency correction-available range, the bit length of the correction values Vcp may be increased.

(3) The embodiments described above are such that 32.768 kHz for a clock is exemplified as the clock frequency fi of the clock signal CK output from the oscillator 6. However, the invention can be applied to a clock frequency other than 32.768 kHz.

(4) The correction value register 4 and the clock time data register 8 maybe substituted for a memory included in the CPU 2 in place thereof.

(5) The first frequency divider 11, the selector 12, and the second frequency divider 13 forming the counter 10 shown in FIG. 2 may be composed of flip-flop circuits or logic circuits other than shown in and described with reference to the figures.

(6) The frequency divider circuit 20 shown in FIG. 3 may be composed of flip-flop circuits other than shown in and described with reference to the figures.

(7) The correction timing generator 30 shown in FIG. 4 and the correction signal generator 40 shown in FIG. 5 may be composed of logic circuits other than shown in and described with reference to the figures.

(8) The frequency corrector 5 in the embodiments may be provided to another circuit or device other than the clocking apparatus.

(9) The relationship between the correction values Vcp[7:0] and the frequency correction factors may be set to values other than the setting values which are two's complements shown in FIG. 11. There are the following examples (9a) and (9b) other than two's complements.

(9a) A case in which a hexadecimal value 7FH is set to +121.1 ppm, . . . 01H is set to +0.95 ppm, 00H is set to ±0 ppm, FFH is set to ±0 ppm, FHE is set to −0.95 ppm, and . . . 80H is set to −121.1 ppm.

(9b) A case in which a hexadecimal value 00H is set to +121.1 ppm, . . . 7FH is set to 0.95 ppm, 80H is set to ±0 ppm, 81H is set to +0.95 ppm, and . . . FFH is set to +121.1 ppm.

The entire disclosure of Japanese patent application No. 2008-3063 filed on Jan. 10, 2008, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A frequency corrector comprising:

a counter operative in response to a clock signal input at a first clock frequency for counting a number of clock pulses of the clock signal to divide the clock signal into a fraction of a natural number larger than unity to generate a signal at a second clock frequency, and for correcting a number of clock pulses of the signal at the second clock frequency in response to a correction signal to output a first frequency-divided signal;

a frequency divider circuit that divides the first frequency-divided signal to output a unit time signal at a predetermined clock frequency and a second frequency-divided signal including a plurality of clock frequencies;

a correction timing generator that decodes the first frequency-divided signal and the second frequency-divided signal to detect a correction timing for the first frequency-divided signal, and generates a plurality of correction timing signals different in timing from each other to output the plurality of correction timing signals; and a correction signal generator that generates the correction signal in response to the correction timing signals and correction values to provide the correction signal to said counter.

2. The frequency corrector according to claim 1, wherein said counter comprises:

a first divider that counts the number of clock pulses of the clock signal and divides the clock signal to output a first plurality of frequency-divided results;

a selector that selects the first plurality of frequency-divided results in response to the correction signal to output a selected result; and a second divider that counts the number of clock pulses of the clock signal and divides the selected result to output the first frequency-divided signal.

3. The frequency corrector according to claim 2, wherein said first divider comprises first and second flip-flop circuits that count the number of clock pulses of the clock signal, and divide the clock signal into a fraction of two to output two first frequency-divided results, said selector comprising a logic circuit that selects the two first frequency-divided results in response to two-bit correction signals to output the selected result, said second frequency divider comprising a third flip-flop circuit that divides the selected result into a fraction of two in response to the clock signal to output the first frequency-divided results.

4. The frequency corrector according to claim 1, wherein said frequency divider circuit comprises a plurality of flip-flop circuits which are interconnected in cascade.

5. The frequency corrector according to claim 1, wherein said correction timing generator comprises a logic circuit that derives a logic of the first frequency-divided signal and the second frequency-divided signal to generate the correction timing signals.

6. The frequency corrector according to claim 1, wherein said correction signal generator comprises a logic circuit that derives a logic of the correction timing signals and the correction values to generate the correction signal .

7. A clocking apparatus comprising a frequency corrector which comprises:

a counter operative in response to a clock signal input at a first clock frequency for counting a number of clock pulses of the clock signal to divide the clock signal into a fraction of a natural number larger than unity to generate a signal at a second clock frequency, and for correcting a number of clock pulses of the signal at the second clock frequency in response to a correction signal to output a first frequency-divided signal;

a frequency divider circuit that divides the first frequency-divided signal to output a unit time signal at a predetermined clock frequency and a second frequency-divided signal including a plurality of clock frequencies;

a correction timing generator that decodes the first frequency-divided signal and the second frequency-divided signal to detect a correction timing for the first frequency-divided signal, and generates a plurality of correction timing signals different in timing from each other to output the plurality of correction timing signals; and a correction signal generator that generates the correction signal in response to the correction timing signals and correction values to provide the correction signal to said counter, said apparatus further comprising:

a clocking counter that generates clock time data in response to the unit time signal output from said frequency divider circuit to output the clock time data; and an operational circuit operative at a predetermined time interval for finding an error between reference clock time data and the clock time data, and for calculating the correction values on a basis of the error and the predetermined time interval to provide the correction values to said correction signal generator.

8. A clocking apparatus comprising a frequency corrector which comprises:

a counter operative in response to a clock signal input at a first clock frequency for counting a number of clock pulses of the clock signal to divide the clock signal into a fraction of a natural number larger than unity to generate a signal at a second clock frequency, and for correcting a number of clock pulses of the signal at the second clock frequency in response to a correction signal to output a first frequency-divided signal;

a frequency divider circuit that divides the first frequency-divided signal to output a unit time signal at a predetermined clock frequency and a second frequency-divided signal including a plurality of clock frequencies;

a correction timing generator that decodes the first frequency-divided signal and the second frequency-divided signal to detect a correction timing for the first frequency-divided signal, and generates a plurality of correction timing signals different in timing from each other to output the plurality of correction timing signals; and a correction signal generator that generates the correction signal in response to the correction timing signals and correction values to provide the correction signal to said counter, said apparatus further comprising:

a clocking counter that generates clock time data in response to the unit time signal output from said frequency divider circuit to output the clock time data;

an operational circuit operative at a specific time interval resultant from subtracting previous reference clock time data from new reference clock time data for finding an error between the new reference clock time data and the clock time data, and for calculating the correction values on the basis of the error and the specific time interval to provide the correction values to said correction signal generator; and a clock time data storage circuit for storing the new reference clock time data every time said operational circuit calculates the error and the correction values, and for providing the stored previous reference clock time data to said operational circuit.

* * * * *